US009192981B2

(12) United States Patent
Forbes Jones et al.

(10) Patent No.: US 9,192,981 B2
(45) Date of Patent: Nov. 24, 2015

(54) THERMOMECHANICAL PROCESSING OF HIGH STRENGTH NON-MAGNETIC CORROSION RESISTANT MATERIAL

(71) Applicant: ATI PROPERTIES, INC., Albany, OR (US)

(72) Inventors: Robin M. Forbes Jones, Charlotte, NC (US); George J. Smith, Jr., Wingate, NC (US); Jason P. Floder, Gastonia, NC (US); Jean-Philippe A. Thomas, Charlotte, NC (US); Ramesh S. Minisandram, Charlotte, NC (US)

(73) Assignee: ATI Properties, Inc., Albany, OR (US)

( * ) Notice: Subject to any disclaimer, the term of this patent is extended or adjusted under 35 U.S.C. 154(b) by 245 days.

(21) Appl. No.: 13/792,285

(22) Filed: Mar. 11, 2013

(65) Prior Publication Data

US 2014/0255719 A1 Sep. 11, 2014

(51) Int. Cl.
*B21J 5/02* (2006.01)
*C21D 8/00* (2006.01)
(Continued)

(52) U.S. Cl.
CPC .. *B21J 5/022* (2013.01); *B21J 1/02* (2013.01); *B21J 1/04* (2013.01); *C21D 6/004* (2013.01);
(Continued)

(58) Field of Classification Search
CPC ..... B21J 1/003; B21J 1/02; B21J 1/04; B21J 5/022; B21J 1/06; B21J 5/02; B21J 5/06; B21J 9/02; B21J 9/022; C21D 7/13; C21D 8/005
USPC ..... 72/356, 700
See application file for complete search history.

(56) References Cited

U.S. PATENT DOCUMENTS 2,857,269 A 10/1958 Vordahl
2,932,886 A 4/1960 Althouse
(Continued)

FOREIGN PATENT DOCUMENTS

CN 1070230 A 3/1993
CN 1194671 A 9/1998
(Continued)

OTHER PUBLICATIONS

"Allvac TiOsteum and TiOstalloy Beat Titanium Alloys", printed from www.allvac.com/allvac/pages/Titanium/TiOsteum.htm on Nov. 7, 2005.
(Continued)

*Primary Examiner* — Edward Tolan
(74) *Attorney, Agent, or Firm* — K & L Gates LLP; John E. Grosselin, III

(57) ABSTRACT

A method of processing a non-magnetic alloy workpiece comprises heating the workpiece to a warm working temperature, open die press forging the workpiece to impart a desired strain in a central region of the workpiece, and radial forging the workpiece to impart a desired strain in a surface region of the workpiece. In a non-limiting embodiment, after the steps of open die press forging and radial forging, the strain imparted in the surface region is substantially equivalent to the strain imparted in the central region. In another non-limiting embodiment, the strain imparted in the central and surface regions are in a range from 0.3 inch/inch to 1 inch/inch, and there exists no more than a 0.5 inch/inch difference in strain of the central region compared with the strain of the surface region of the workpiece. An alloy forging processed according to methods described herein also is disclosed.

28 Claims, 6 Drawing Sheets

(51) Int. Cl.

| | |
|---|---|
| ***B21J 1/02*** | (2006.01) |
| ***B21J 1/04*** | (2006.01) |
| ***C21D 6/00*** | (2006.01) |
| ***C21D 7/13*** | (2006.01) |
| *B21J 5/08* | (2006.01) |
| *B21J 7/14* | (2006.01) |

(52) U.S. Cl.
CPC *C21D 7/13* (2013.01); *C21D 8/005* (2013.01); *B21J 5/08* (2013.01); *B21J 7/14* (2013.01); *Y10T 428/1241* (2015.01)

(56) References Cited

U.S. PATENT DOCUMENTS 2,974,076 A 3/1961 Vordahl
3,015,292 A 1/1962 Bridwell
3,025,905 A 3/1962 Haerr
3,060,564 A 10/1962 Corral
3,082,083 A * 3/1963 Levy et al. ..... 420/42
3,313,138 A 4/1967 Spring et al.
3,379,522 A 4/1968 Vordahl
3,489,617 A 1/1970 Wuerfel
3,584,487 A 6/1971 Carlson
3,605,477 A 9/1971 Carlson
3,615,378 A 10/1971 Bomberger, Jr. et al.
3,635,068 A 1/1972 Watmough et al.
3,686,041 A 8/1972 Lee
3,815,395 A 6/1974 Sass
3,835,282 A 9/1974 Sass et al.
3,922,899 A 12/1975 Fremont et al.
3,979,815 A 9/1976 Nakanose et al.
4,053,330 A 10/1977 Henricks et al.
4,067,734 A 1/1978 Curtis et al.
4,094,708 A 6/1978 Hubbard et al.
4,098,623 A 7/1978 Ibaraki et al.
4,120,187 A 10/1978 Mullen
4,138,141 A 2/1979 Andersen
4,147,639 A 4/1979 Lee et al.
4,150,279 A 4/1979 Metcalfe et al.
4,163,380 A 8/1979 Masoner
4,197,643 A 4/1980 Burstone et al.
4,229,216 A 10/1980 Paton et al.
4,309,226 A 1/1982 Chen
4,472,207 A 9/1984 Kinoshita et al.
4,482,398 A 11/1984 Eylon et al.
4,510,788 A * 4/1985 Ferguson et al. ..... 72/377
4,543,132 A 9/1985 Berczik et al.
4,631,092 A 12/1986 Ruckle et al.
4,639,281 A 1/1987 Sastry et al.
4,668,290 A 5/1987 Wang et al.
4,687,290 A 8/1987 Prussas
4,688,290 A 8/1987 Hogg
4,690,716 A 9/1987 Sabol et al.
4,714,468 A 12/1987 Wang et al.
4,799,975 A 1/1989 Ouchi et al.
4,808,249 A 2/1989 Eyelon et al.
4,842,653 A 6/1989 Wirth et al.
4,851,055 A 7/1989 Eylon et al.
4,854,977 A 8/1989 Alheritiere et al.
4,857,269 A 8/1989 Wang et al.
4,878,966 A 11/1989 Alheritiere et al.
4,888,973 A 12/1989 Comley
4,889,170 A 12/1989 Mae et al.
4,919,728 A 4/1990 Kohl et al.
4,943,412 A 7/1990 Bania et al.
4,957,567 A * 9/1990 Krueger et al. ..... 419/41
4,975,125 A 12/1990 Chakrabarti et al.
4,980,127 A 12/1990 Parris et al.
5,026,520 A 6/1991 Bhowal et al.
5,032,189 A 7/1991 Eylon et al.
5,041,262 A 8/1991 Gigliotti, Jr.
5,074,907 A 12/1991 Amato et al.
5,080,727 A 1/1992 Aihara et al.
5,094,812 A * 3/1992 Dulmaine et al. ..... 420/57
5,141,566 A 8/1992 Kitayama et al.
5,156,807 A 10/1992 Nagata et al.
5,162,159 A 11/1992 Tenhover et al.
5,169,597 A 12/1992 Davidson et al.
5,173,134 A 12/1992 Chakrabarti et al.
5,201,457 A 4/1993 Kitayama et al.
5,244,517 A 9/1993 Kimura et al.
5,264,055 A 11/1993 Champin et al.
5,277,718 A 1/1994 Paxson et al.
5,310,522 A 5/1994 Culling
5,332,454 A 7/1994 Meredith et al.
5,332,545 A 7/1994 Love
5,342,458 A 8/1994 Adams et al.
5,358,586 A 10/1994 Schutz
5,359,872 A 11/1994 Nashiki
5,360,496 A 11/1994 Kuhlman et al.
5,442,847 A 8/1995 Semiatin et al.
5,472,526 A 12/1995 Gigliotti, Jr.
5,494,636 A 2/1996 Dupioron et al.
5,509,979 A 4/1996 Kimura
5,516,375 A 5/1996 Ogawa et al.
5,520,879 A 5/1996 Saito et al.
5,545,262 A 8/1996 Hardee et al.
5,545,268 A 8/1996 Yashiki et al.
5,547,523 A * 8/1996 Blankenship et al. ..... 148/677
5,558,728 A 9/1996 Kobayashi et al.
5,580,665 A 12/1996 Taguchi et al.
5,600,989 A 2/1997 Segal et al.
5,649,280 A 7/1997 Blankenship et al.
5,658,403 A 8/1997 Kimura
5,662,745 A 9/1997 Takayama et al.
5,679,183 A 10/1997 Takagi et al.
5,698,050 A 12/1997 El-Soudani
5,758,420 A 6/1998 Schmidt et al.
5,759,305 A * 6/1998 Benz et al. ..... 148/514
5,759,484 A 6/1998 Kashii et al.
5,795,413 A 8/1998 Gorman
5,871,595 A 2/1999 Ahmed et al.
5,896,643 A 4/1999 Tanaka
5,897,830 A 4/1999 Abkowitz et al.
5,954,724 A 9/1999 Davidson
5,980,655 A 11/1999 Kosaka
6,002,118 A 12/1999 Kawano et al.
6,032,508 A * 3/2000 Ashworth et al. ..... 72/359
6,044,685 A * 4/2000 Delgado et al. ..... 72/356
6,053,993 A 4/2000 Reichman et al.
6,059,904 A * 5/2000 Benz et al. ..... 148/676
6,071,360 A 6/2000 Gillespie
6,077,369 A 6/2000 Kusano et al.
6,127,044 A 10/2000 Yamamoto et al.
6,132,526 A 10/2000 Carisey et al.
6,139,659 A 10/2000 Takahashi et al.
6,143,241 A 11/2000 Hajaligol et al.
6,187,045 B1 2/2001 Fehring et al.
6,197,129 B1 3/2001 Zhu et al.
6,200,685 B1 3/2001 Davidson
6,209,379 B1 4/2001 Nishida et al.
6,216,508 B1 4/2001 Matsubara et al.
6,228,189 B1 5/2001 Oyama et al.
6,250,812 B1 6/2001 Ueda et al.
6,258,182 B1 7/2001 Schetky et al.
6,284,071 B1 9/2001 Suzuki et al.
6,332,935 B1 12/2001 Gorman et al.
6,334,350 B1 1/2002 Shin et al.
6,384,388 B1 5/2002 Anderson et al.
6,387,197 B1 5/2002 Bewlay et al.
6,391,128 B2 5/2002 Ueda et al.
6,399,215 B1 6/2002 Zhu et al.
6,402,859 B1 6/2002 Ishii et al.
6,409,852 B1 6/2002 Lin et al.
6,532,786 B1 3/2003 Luttgeharm
6,536,110 B2 3/2003 Smith et al.
6,539,607 B1 4/2003 Fehring et al.
6,539,765 B2 4/2003 Gates
6,558,273 B2 5/2003 Kobayashi et al.
6,561,002 B2 5/2003 Okada et al.
6,569,270 B2 5/2003 Segal
6,632,304 B2 10/2003 Oyama et al.
6,663,501 B2 12/2003 Chen

(56) References Cited

U.S. PATENT DOCUMENTS

| | | | | |
|---|---|---|---|---|
| 6,726,784 | B2 | 4/2004 | Oyama et al. | |
| 6,742,239 | B2 | 6/2004 | Lee et al. | |
| 6,764,647 | B2 | 7/2004 | Aigner et al. | |
| 6,773,520 | B1 | 8/2004 | Fehring et al. | |
| 6,786,985 | B2 | 9/2004 | Kosaka et al. | |
| 6,800,153 | B2 | 10/2004 | Ishii et al. | |
| 6,823,705 | B2 | 11/2004 | Fukuda et al. | |
| 6,908,517 | B2 | 6/2005 | Segal et al. | |
| 6,918,971 | B2 | 7/2005 | Fujii et al. | |
| 6,932,877 | B2 | 8/2005 | Raymond et al. | |
| 6,971,256 | B2 | 12/2005 | Okada et al. | |
| 7,010,950 | B2 | 3/2006 | Cai et al. | |
| 7,032,426 | B2 | 4/2006 | Durney et al. | |
| 7,037,389 | B2 | 5/2006 | Barbier et al. | |
| 7,038,426 | B2 | 5/2006 | Hill | |
| 7,096,596 | B2 | 8/2006 | Hernandez, Jr. et al. | |
| 7,132,021 | B2 | 11/2006 | Kuroda et al. | |
| 7,152,449 | B2 | 12/2006 | Durney et al. | |
| 7,264,682 | B2 | 9/2007 | Chandran | |
| 7,269,986 | B2 | 9/2007 | Pfaffmann et al. | |
| 7,332,043 | B2 | 2/2008 | Tetyukhin et al. | |
| 7,410,610 | B2 | 8/2008 | Woodfield et al. | |
| 7,438,849 | B2 | 10/2008 | Kuramoto et al. | |
| 7,449,075 | B2 | 11/2008 | Woodfield et al. | |
| 7,536,892 | B2 | 5/2009 | Amino et al. | |
| 7,559,221 | B2 | 7/2009 | Horita et al. | |
| 7,611,592 | B2 | 11/2009 | Davis et al. | |
| 7,837,812 | B2 | 11/2010 | Marquardt et al. | |
| 7,879,286 | B2 | 2/2011 | Miracle et al. | |
| 7,984,635 | B2 | 7/2011 | Callebaut et al. | |
| 8,037,730 | B2 | 10/2011 | Polen et al. | |
| 8,048,240 | B2 | 11/2011 | Hebda et al. | |
| 8,128,764 | B2 | 3/2012 | Miracle et al. | |
| 8,316,687 | B2 | 11/2012 | Slattery | |
| 8,336,359 | B2 | 12/2012 | Werz | |
| 8,408,039 | B2 | 4/2013 | Cao et al. | |
| 8,499,605 | B2 | 8/2013 | Bryan | |
| 8,578,748 | B2 | 11/2013 | Huskamp et al. | |
| 8,679,269 | B2 * | 3/2014 | Goller et al. | 148/677 |
| 2003/0168138 | A1 | 9/2003 | Marquardt | |
| 2004/0099350 | A1 | 5/2004 | Manitone et al. | |
| 2004/0148997 | A1 | 8/2004 | Amino et al. | |
| 2004/0221929 | A1 | 11/2004 | Hebda et al. | |
| 2004/0250932 | A1 | 12/2004 | Briggs | |
| 2005/0145310 | A1 | 7/2005 | Bewlay et al. | |
| 2006/0110614 | A1 | 5/2006 | Liimatainen | |
| 2006/0243356 | A1 | 11/2006 | Oikawa et al. | |
| 2007/0017273 | A1 | 1/2007 | Haug et al. | |
| 2007/0193662 | A1 | 8/2007 | Jablokov et al. | |
| 2007/0286761 | A1 | 12/2007 | Miracle et al. | |
| 2008/0000554 | A1 * | 1/2008 | Yaguchi et al. | 148/327 |
| 2008/0103543 | A1 | 5/2008 | Li et al. | |
| 2008/0107559 | A1 | 5/2008 | Nishiyama et al. | |
| 2008/0202189 | A1 | 8/2008 | Otaki | |
| 2008/0210345 | A1 | 9/2008 | Tetyukhin et al. | |
| 2008/0264932 | A1 | 10/2008 | Hirota | |
| 2009/0000706 | A1 * | 1/2009 | Huron et al. | 148/556 |
| 2009/0183804 | A1 | 7/2009 | Zhao et al. | |
| 2009/0234385 | A1 | 9/2009 | Cichocki et al. | |
| 2010/0307647 | A1 | 12/2010 | Marquardt et al. | |
| 2011/0038751 | A1 | 2/2011 | Marquardt et al. | |
| 2011/0180188 | A1 | 7/2011 | Bryan et al. | |
| 2012/0003118 | A1 | 1/2012 | Hebda et al. | |
| 2012/0012233 | A1 | 1/2012 | Bryan | |
| 2012/0060981 | A1 | 3/2012 | Forbes Jones et al. | |
| 2012/0067100 | A1 | 3/2012 | Stefansson et al. | |
| 2012/0076611 | A1 | 3/2012 | Bryan | |
| 2012/0076612 | A1 | 3/2012 | Bryan | |
| 2012/0076686 | A1 | 3/2012 | Bryan | |
| 2012/0177532 | A1 | 7/2012 | Hebda et al. | |
| 2012/0279351 | A1 * | 11/2012 | Gu et al. | 75/228 |
| 2012/0308428 | A1 | 12/2012 | Forbes Jones et al. | |
| 2013/0062003 | A1 | 3/2013 | Shulkin et al. | |
| 2013/0118653 | A1 | 5/2013 | Bryan et al. | |
| 2014/0060138 | A1 | 3/2014 | Hebda et al. | |
| 2014/0076468 | A1 | 3/2014 | Marquardt et al. | |
| 2014/0076471 | A1 | 3/2014 | Forbes Jones et al. | |
| 2014/0116582 | A1 | 5/2014 | Forbes Jones et al. | |

FOREIGN PATENT DOCUMENTS

| | | | |
|---|---|---|---|
| CN | 1403622 | | 3/2003 |
| CN | 1816641 | A | 8/2006 |
| CN | 101104898 | A | 1/2008 |
| CN | 101205593 | A | 6/2008 |
| CN | 101684530 | A | 3/2010 |
| CN | 101637789 | B | 6/2011 |
| CN | 102212716 | A | 10/2011 |
| DE | 19743802 | A1 | 3/1999 |
| DE | 10128199 | A1 | 12/2002 |
| DE | 102010009185 | A1 | 11/2011 |
| EP | 0066361 | A2 | 12/1982 |
| EP | 0109350 | A2 | 5/1984 |
| EP | 0320820 | A1 | 6/1989 |
| EP | 0535817 | B1 | 4/1995 |
| EP | 0611831 | B1 | 1/1997 |
| EP | 0834580 | A1 | 4/1998 |
| EP | 0870845 | A1 | 10/1998 |
| EP | 0707085 | B1 | 1/1999 |
| EP | 0683242 | B1 | 5/1999 |
| EP | 0969109 | A1 | 1/2000 |
| EP | 1083243 | A2 | 3/2001 |
| EP | 1136582 | A1 | 9/2001 |
| EP | 1302554 | A1 | 4/2003 |
| EP | 1302555 | A1 | 4/2003 |
| EP | 1471158 | A1 | 10/2004 |
| EP | 1605073 | A1 | 12/2005 |
| EP | 1612289 | A2 | 1/2006 |
| EP | 1717330 | A1 | 11/2006 |
| EP | 1882752 | A2 | 1/2008 |
| EP | 2028435 | A1 | 2/2009 |
| EP | 2281908 | A1 | 2/2011 |
| EP | 1546429 | B1 | 6/2012 |
| FR | 2545104 | A1 | 11/1984 |
| GB | 847103 | | 9/1960 |
| GB | 1170997 | A | 11/1969 |
| GB | 1433306 | | 4/1976 |
| GB | 2151260 | A | 7/1985 |
| GB | 2337762 | A | 12/1999 |
| JP | 55-113865 | A | 9/1980 |
| JP | 57-62820 | A | 4/1982 |
| JP | 57-62846 | A | 4/1982 |
| JP | 60-046358 | | 3/1985 |
| JP | 60-100655 | A | 6/1985 |
| JP | 62-109956 | A | 5/1987 |
| JP | 62-149859 | A | 7/1987 |
| JP | 1-279736 | A | 11/1989 |
| JP | 2-205661 | A | 8/1990 |
| JP | 3-134124 | A | 6/1991 |
| JP | H03-264618 | A | 11/1991 |
| JP | 4-74856 | A | 3/1992 |
| JP | 4-103737 | A | 4/1992 |
| JP | 5-59510 | A | 3/1993 |
| JP | 5-117791 | A | 5/1993 |
| JP | 5-195175 | A | 8/1993 |
| JP | 8-300044 | A | 11/1996 |
| JP | 9-194969 | A | 7/1997 |
| JP | 9-215786 | A | 8/1997 |
| JP | H10-306335 | A | 11/1998 |
| JP | 11-343528 | A | 12/1999 |
| JP | 11-343548 | A | 12/1999 |
| JP | 2000-153372 | A | 6/2000 |
| JP | 2003-55749 | A | 2/2003 |
| JP | 2003-74566 | A | 3/2003 |
| JP | 2003-334633 | A | 11/2003 |
| JP | 2009-299110 | A | 12/2009 |
| JP | 2009-299120 | A | 12/2009 |
| JP | 2010-70833 | A | 4/2010 |
| JP | 2012-140690 | A | 7/2012 |
| KR | 920004946 | | 6/1992 |
| KR | 10-2005-0087765 | A | 8/2005 |
| RU | 2197555 | C1 | 7/2001 |
| RU | 2172359 | C1 | 8/2001 |
| SU | 534518 | A1 | 1/1977 |

(56) References Cited

FOREIGN PATENT DOCUMENTS

| | | | |
|---|---|---|---|
| SU | 631234 | A | 11/1978 |
| SU | 1088397 | A1 | 2/1991 |
| UA | 38805 | A | 5/2001 |
| WO | WO 98/17386 | A1 | 4/1998 |
| WO | WO 98/17836 | A1 | 4/1998 |
| WO | WO 98/22629 | A | 5/1998 |
| WO | WO 02/36847 | A2 | 5/2002 |
| WO | WO 02/086172 | A1 | 10/2002 |
| WO | WO 02/090607 | A1 | 11/2002 |
| WO | WO 2004/101838 | A1 | 11/2004 |
| WO | WO 2007/084178 | A2 | 7/2007 |
| WO | WO 2007/114439 | A1 | 10/2007 |
| WO | WO 2008/017257 | A1 | 2/2008 |
| WO | WO 2012/063504 | A1 | 5/2012 |
| WO | WO 2012/147742 | A1 | 11/2012 |
| WO | WO 2013/081770 | A1 | 6/2013 |
| WO | WO 2013/130139 | A2 | 9/2013 |

OTHER PUBLICATIONS

"Datasheet: Timetal 21S", Alloy Digest, Advanced Materials and Processes (Sep. 1998), pp. 38-39.
"Heat Treating of Nonferrous Alloys: Heat Treating of Titanium and Titanium Alloys," Metals Handbook, ASM Handbooks Online (2002).
"Stryker Orthopaedics TMZF® Alloy (UNS R58120)", printed from www.allvac.com/allvac/pages/Titanium/UNSR58120.htm on Nov. 7, 2005.
"Technical Data Sheet: Allvac® Ti-15Mo Beta Titanium Alloy" (dated Jun. 16, 2004).
"ASTM Designation F1801-97 Standard Practice for Corrosion Fatigue Testing of Metallic Implant Materials" ASTM International (1997) pp. 876-880.
"ASTM Designation F2066-01 Standard Specification for Wrought Titanium-15 Molybdenum Alloy for Surgical Implant Applications (UNS R58150)," ASTM International (2000) pp. 1-4.
AL-6XN® Alloy (UNS N08367) Allegheny Ludlum Corporation, 2002, 56 pages.
Allegheny Ludlum, "High Performance Metals for Industry, High Strength, High Temperature, and Corrosion-Resistant Alloys", (2000) pp. 1-8.
Allvac, Product Specification for "Allvac Ti-15 Mo," available at http://www.allvac.com/allvac/pages/Titanium/Ti15MO.htm, last visited Jun. 9, 2003 p. 1 of 1.
Altemp® A286 Iron-Base Superalloy (UNS Designation S66286) Allegheny Ludlum Technical Data Sheet Blue Sheet, 1998, 8 pages.
ASM Materials Engineering Dictionary, J.R. Davis Ed., ASM International, Materials Park, OH (1992) p. 39.
ATI Datalloy 2 Alloy, Technical Data Sheet, ATI Allvac, Monroe, NC, SS-844, Version1, Sep. 17, 2010, 8 pages.
ATI 690 (UNS N06690) Nickel-Base, ATI Allvac, Oct. 5, 2010, 1 page.
Isothermal forging definition, ASM Materials Engineering Dictionary, J.R. Davis ed., Fifth Printing, Jan. 2006, ASM International, p. 238.
Isothermal forging, printed from http://thelibraryofmanufacturing.com/isothermal_forging.html, accessed Jun. 5, 2013, 3 pages.
Adiabatic definition, ASM Materials Engineering Dictionary, J.R. Davis ed., Fifth Printing, Jan. 2006, ASM International, p. 9.
Adiabatic process—Wikipedia, the free encyclopedia, printed from http://en.wikipedia.org/wiki/Adiabatic_process, accessed May 21, 2013, 10 pages.
ASTM Designation F 2066-01, "Standard Specification for Wrought Titanium-15 Molybdenum Alloy for Surgical Implant Applications (UNS R58150)", May 2001, 7 pages.
ATI 6-2-4-2™ Alloy Technical Data Sheet, Version 1, Feb. 26, 2012, 4 pages.
ATI 6-2-4-6™ Titanium Alloy Data Sheet, accessed Jun. 26, 2012.
ATI 425, High-Strength Titanium Alloy, Alloy Digest, ASM International, Jul. 2004, 2 pages.
ATI 425® Alloy Applications, retrieved from http://web.archive.org/web/20100704044024/http://www.alleghenytechnologies.com/ATI425/applications/default.asp#other, Jul. 4, 2010, Way Back Machine, 2 pages.
ATI 425® Alloy, Technical Data Sheet, retrieved from http://web.archive.org/web/20100703120218/http://www.alleghenytechnologies.com/ATI425/specifications/datasheet.asp, Jul. 3, 2010, Way Back Machine, 5 pages.
ATI 425®-MIL Alloy, Technical Data Sheet, Version 1, May 28, 2010, pp. 1-5.
ATI 425®-MIL Alloy, Technical Data Sheet, Version 2, Aug. 16, 2010, 5 pages.
ATI 425®-MIL Titanium Alloy, Mission Critical Metallics®, Version 3, Sep. 10, 2009, pp. 1-4.
ATI 425® Titanium Alloy, Grade 38 Technical Data Sheet, Version 1, Feb. 1, 2012, pp. 1-6.
ATI 500-MIL™, Mission Critical Metallics®, High Hard Specialty Steel Armor, Version 4, Sep. 10, 2009, pp. 1-4.
ATI 600-MIL®, Preliminary Draft Data Sheet, Ultra High Hard Specialty Steel Armor, Version 4, Aug. 10, 2010, pp. 1-3.
ATI 600-MIL™, Preliminary Draft Data Sheet, Ultra High Hard Specialty Steel Armor, Version 3, Sep. 10, 2009, pp. 1-3.
ATI Aerospace Materials Development, Mission Critical Metallics, Apr. 30, 2008, 17 pages.
ATI Ti-15Mo Beta Titanium Alloy Technical Data Sheet, ATI Allvac, Monroe, NC, Mar. 21, 2008, 3 pages.
ATI Titanium 6Al-2Sn-4Zr-2Mo Alloy, Technical Data Sheet, Version 1, Sep. 17, 2010, pp. 1-3.
ATI Titanium 6Al-4V Alloy, Mission Critical Metallics®, Technical Data Sheet, Version 1, Apr. 22, 2010, pp. 1-3.
ATI Wah Chang, ATI™ 425 Titanium Alloy (Ti-4Al-2.5V-1.5Fe-0.2502), Technical Data Sheet, 2004, pp. 1-5.
ATI Wah Chang, Titanium and Titanium Alloys, Technical Data Sheet, 2003, pp. 1-16.
Beal et al., "Forming of Titanium and Titanium Alloys-Cold Forming", ASM Handbook, 2006, ASM International, vol. 14B, 2 pages.
Bewlay, et al., "Superplastic roll forming of Ti alloys", Materials and Design, 21, 2000, pp. 287-295.
Bowen, A. W., "Omega Phase Embrittlement in Aged Ti-15%Mo," Scripta Metallurgica, vol. 5, No. 8 (1971) pp. 709-715.
Bowen, A. W., "On the Strengthening of a Metastable b-Titanium Alloy by w- and a-Precipitation" Royal Aircraft Establishment Technical Memorandum Mat 338, (1980) pp. 1-15 and Figs 1-5.
Boyer, Rodney R., "Introduction and Overview of Titanium and Titanium Alloys: Applications," Metals Handbook, ASM Handbooks Online (2002).
Cain, Patrick, "Warm forming aluminum magnesium components; How it can optimize formability, reduce springback", Aug. 1, 2009, from http://www.thefabricator.com/article/presstechnology/warm-forming-aluminum-magnesium-components, 3 pages.
Callister, Jr., William D., Materials Science and Engineering, An Introduction, Sixth Edition, John Wiley & Sons, pp. 180-184 (2003).
Desrayaud et al., "A novel high straining process for bulk materials—The development of a multipass forging system by compression along three axes", Journal of Materials Processing Technology, 172, 2006, pp. 152-158.
DiDomizio, et al., "Evaluation of a Ni-20Cr Alloy Processed by Multi-axis Forging", Materials Science Forum vols. 503-504, 2006, pp. 793-798.
Disegi, J. A., "Titanium Alloys for Fracture Fixation Implants," Injury International Journal of the Care of the Injured, vol. 31 (2000) pp. S-D14-17.
Disegi, John, Wrought Titanium—15% Molybdenum Implant Material, Original Instruments and Implants of the Association for the Study of International Fixation—AO ASIF, Oct. 2003.
Donachie Jr., M.J., "Titanium a Technical Guide" 1988, ASM, pp. 39 and 46-50.
Duflou et al., "A method for force reduction in heavy duty bending", Int. J. Materials and Product Technology, vol. 32, No. 4, 2008, pp. 460-475.
Elements of Metallurgy and Engineering Alloys, Editor F. C. Campbell, ASM International, 2008, Chapter 8, p. 125.

(56) References Cited

OTHER PUBLICATIONS

Fedotov, S.G. et al., "Effect of Aluminum and Oxygen on the Formation of Metastable Phases in Alloys of Titanium with .beta.-Stabilizing Elements", Izvestiya Akademii Nauk SSSR, Metally (1974) pp. 121-126.
Froes, F. H. et al., "The Processing Window for Grain Size Control in Metastable Beta Titanium Alloys", Beta Titanium Alloys in the 80's, ed. by R. Boyer and H. Rosenberg, AIME, 1984, pp. 161-164.
Gigliotti et al., "Evaluation of Superplast cally Roll Formed VT-25", Titamium'99, Science and Technology, 2000, pp. 1581-1588.
Gilbert et al., "Heat Treating of Titanium and Titanium Alloys-Solution Treating and Aging", ASM Handbook, 1991, ASM International, vol. 4, pp. 1-8.
Greenfield, Dan L., News Release, ATI Aerospace Presents Results of Year-Long Characterization Program for New ATI 425 Alloy Titanium Products at Aeromat 2010, Jun. 21, 2010, Pittsburgh, Pennsylvania, 1 page.
Harper, Megan Lynn, "A Study of the Microstructural and Phase Evolutions in Timetal 555", Jan. 2001, retrieved from http://www.ohiolink.edu/etd/send-pdf.cgi/harper%20megan%20lynn.pdf?acc_num=osu1132165471 on Aug. 10, 2009, 92 pages.
Hawkins, M.J. et al., "Osseointegration of a New Beta Titanium Alloy as Compared to Standard Orthopaedic Implant Metals," Sixth World Biomaterials Congress Transactions, Society for Biomaterials, 2000, p. 1083.
Ho, W.F. et al., "Structure and Properties of Cast Binary Ti-Mo Alloys" Biomaterials, vol. 20 (1999) pp. 2115-2122.
Imatani et al., "Experiment and simulation for thick-plate bending by high frequency inductor", ACTA Metallurgica Sinica, vol. 11, No. 6, Dec. 1998, pp. 449-455.
Imayev et al., "Formation of submicrocrystalline structure in TiAl intermetallic compound", Journal of Materials Science, 27, 1992, pp. 4465-4471.
Imayev et al., "Principles of Fabrication of Bulk Ultrafine-Grained and Nanostructured Materials by Multiple Isothermal Forging", Materials Science Forum, vols. 638-642, 2010, pp. 1702-1707.
Imperial Metal Industries Limited, Product Specification for "IMI Titanium 205", The Kynoch Press (England) pp. 1-5, (publication date unknown).
Jablokov et al., "Influence of Oxygen Content on the Mechanical Properties of Titanium-35Niobium-7Zirconium-5Tantalum Beta Titanium Alloy," Journal of ASTM International, Sep. 2005, vol. 2, No. 8, pp. 1-12.
Jablokov et al., "The Application of Ti-15 Mo Beta Titanium Alloy in High Strength Orthopaedic Applications", Journal of ASTM International, vol. 2, Issue 8 (Sep. 2005) (published online Jun. 22, 2005).
Kovtun, et al., "Method of calculating induction heating of steel sheets during thermomechanical bending", Kiev, Nikolaev, translated from Problemy Prochnosti, No. 5, pp. 105-110, May 1978, original article submitted Nov. 27, 1977, pp. 600-606.
Lampman, S., "Wrought and Titanium Alloys," ASM Handbooks Online, ASM International, 2002.
Lee et al., "An electromagnetic and thermo-mechanical analysis of high frequency induction heating for steel plate bending", Key Engineering Materials, vols. 326-328, 2006, pp. 1283-1286.
Lemons, Jack et al., "Metallic Biomaterials for Surgical Implant Devices," BONEZone, Fall (2002) p. 5-9 and Table.
Long, M. et al., "Friction and Surface Behavior of Selected Titanium Alloys During Reciprocating-Sliding Motion", Wear, 249(1-2), Jan. 17, 2001, 158-168.
Lütjering, G. and J.C. Williams, Titanium, Springer, New York (2nd ed. 2007) p. 24.
Lutjering, G. and Williams, J.C., Titanium, Springer-Verlag, 2003, Ch. 5: Alpha+Beta Alloys, p. 177-201.
Marquardt et al., "Beta Titanium Alloy Processed for High Strength Orthopaedic Applications, " Journal of ASTM International, vol. 2, Issue 9 (Oct. 2005) (published online Aug. 17, 2005).
Marquardt, Brian, "Characterization of Ti-15Mo for Orthopaedic Applications," TMS 2005 Annual Meeting: Technical Program, San Francisco, CA, Feb. 13-17, 2005 Abstract, p. 239.
Marquardt, Brian, "Ti-15Mo Beta Titanium Alloy Processed for High Strength Orthopaedic Applications," Program and Abstracts for the Symposium on Titanium, Niobium, Zirconium, and Tantalum for Medical and Surgical Applications, Washington, D.C., Nov. 9-10, 2004 Abstract, p. 11.
Marte et al., "Structure and Properties of NI-20CR Produced by Severe Plastic Deformation", Ultrafine Grained Materials IV, 2006, pp. 419-424.
Materials Properties Handbook: Titanium Alloys, Eds. Boyer et al, ASM International, Materials Park, OH, 1994, pp. 524-525.
Martinelli, Gianni and Roberto Peroni, "Isothermal forging of Ti-alloys for medical applications", Presented at the 11th World Conference on Titanium, Kyoto, Japan, Jun. 4-7, 2007, accessed Jun. 5, 2013, 5 pages.
McDevitt, et al., Characterization of the Mechanical Properties of ATI 425 Alloy According to the Guidelines of the Metallic Materials Properties Development & Standardization Handbook, Aeromat 2010 Conference and Exposition: Jun. 20-24, 2010, Bellevue, WA, 23 pages.
Metals Handbook, Desk Edition, 2nd ed., J. R. Davis ed., ASM International, Materials Park, Ohio (1998), pp. 575-588.
Military Standard, Fastener Test Methods, Method 13, Double Shear Test, MIL-STD-1312-13, Jul. 26, 1985, superseding MIL-STD-1312 (in part) May 31, 1967, 8 pages.
Military Standard, Fastener Test Methods, Method 13, Double Shear Test, MIL-STD-1312-13A, Aug. 23, 1991, superseding MIL-STD-13, Jul. 26, 1985, 10 pages.
Murray JL, et al., Binary Alloy Phase Diagrams, Second Edition, vol. 1, Ed. Massalski, Materials Park, OH; ASM International; 1990, p. 547.
Murray, J.L., The Mn-Ti (Manganese-Titanium) System, Bulletin of Alloy Phase Diagrams, vol. 2, No. 3 (1981) p. 334-343.
Myers, J., "Primary Working, A lesson from Titanium and its Alloys," ASM Course Book 27 Lesson, Test 9, Aug. 1994, pp. 3-4.
Naik, Uma M. et al., "Omega and Alpha Precipitation in Ti-15Mo Alloy," Titanium '80 Science and Technology-Proceedings of the 4th International Conference on Titanium, H. Kimura & O. Izumi Eds. May 19-22, 1980 pp. 1335-1341.
Nguyen et al., "Analysis of bending deformation in triangle heating of steel plates with induction heating process using laminated plate theory", Mechanics Based Design of Structures and Machines, 37, 2009, pp. 228-246.
Nishimura, T. "Ti-15Mo-5Zr-3Al", Materials Properties Handbook: Titanium Alloys, eds. R. Boyer et al., ASM International, Materials Park, OH, 1994, p. 949.
Nutt, Michael J. et al., "The Application of Ti-15 Beta Titanium Alloy in High Strength Structural Orthopaedic Applications," Program and Abstracts for the Symposium on Titanium Niobium, Zirconium, and Tantalum for Medical and Surgical Applications, Washington, D.C., Nov. 9-10, 2004 Abstract, p. 12.
Nyakana, et al., "Quick Reference Guide for β Titanium Alloys in the 00s", Journal of Materials Engineering and Performance, vol. 14, No. 6, Dec. 1, 2005, pp. 799-811.
Pennock, G.M. et al., "The Control of a Precipitation by Two Step Ageing in β Ti-15Mo," Titanium '80 Science and Technology—Proceedings of the 4th International Conference on Titanium, H. Kimura & O. Izumi Eds. May 19-22, 1980 pp. 1344-1350.
Prasad, Y.V.R.K. et al. "Hot Deformation Mechanism in Ti-6Al-4V with Transformed B Starting Microstructure: Commercial v. Extra Low Interstitial Grade", Materials Science and Technology, Sep. 2000, vol. 16, pp. 1029-1036.
Qazi, J.I. et al., "High-Strength Metastable Beta-Titanium Alloys for Biomedical Applications," JOM, Nov. 2004 pp. 49-51.
Roach, M.D., et al., "Comparison of the Corrosion Fatigue Characteristics of CPTi-Grade 4, Ti-6A1-4V ELI, Ti-6A1-7 Nb, and Ti-15 Mo", Journal of Testing and Evaluation, vol. 2, Issue 7, (Jul./Aug. 2005) (published online Jun. 8, 2005).
Roach, M.D., et al., "Physical, Metallurgical, and Mechanical Comparison of a Low-Nickel Stainless Steel," Transactions on the 27th Meeting of the Society for Biomaterials, Apr. 24-29, 2001, p. 343.
Roach, M.D., et al., "Stress Corrosion Cracking of a Low-Nickel Stainless Steel," Transactions of the 27th Annual Meeting of the Society for Biomaterials, 2001, p. 469.

(56) References Cited

OTHER PUBLICATIONS

Rudnev et at., "Longitudinal flux indication heating of slabs, bars and strips is no longer "Black Magic:" II", Industrial Heating, Feb. 1995, pp. 46-48 and 50-51.
Russo, P.A., "Influence of Ni and Fe on the Creep of Beta Annealed Ti-6242S", Titanium '95: Science and Technology, pp. 1075-1082.
SAE Aerospace Material Specification 4897A (issued Jan. 1997, revised Jan. 2003).
SAE Aerospace, Aerospace Material Specification, Titanium Alloy Bars, Forgings and Forging Stock, 6.0Al-4.0V Annealed, AMS 6931A, Issued Jan. 2004, Revised Feb. 2007, pp. 1-7.
SAE Aerospace, Aerospace Material Specification, Titanium Alloy Bars, Forgings and Forging Stock, 6.0Al-4.0V, Solution Heat Treated and Aged, AMS 6930A, Issued Jan. 2004, Revised Feb. 2006, pp. 1-9.
SAE Aerospace, Aerospace Material Specification, Titanium Alloy, Sheet, Strip, and Plate, 4Al-2.5V-1.5Fe, Annealed, AMS 6946A, Issued Oct. 2006, Revised Jun. 2007, pp. 1-7.
Salishchev et al., "Characterization of Submicron-grained Ti-6Al-4V Sheets with Enhanced Superplastic Properties", Materials Science Forum, Trans Tech Publications, Switzerland, vols. 447-448, 2004, pp. 441-446.
Salishchev et al., "Mechanical Properties of Ti-6Al-4V Titanium Alloy with Submicrocrystalline Structure Produced by Multiaxial Forging", Materials Science Forum, vols. 584-586, 2008, pp. 783-788.
Salishchev, et al., "Effect of Deformation Conditions on Grain Size and Microstructure Homogeneity of 13-Rich Titanium Alloys", Journal of Materials Engineering and Performance, vol. 14(6), Dec. 2005, pp. 709-716.
Salishchev, G.A., "Formation of submicrocrystalline structure in large size billets and sheets out of titanium alloys", Institute for Metals Superplasticity Problems,Ufa, Russia, presented at 2003 NATO Advanced Research Workshop, Kyiv, Ukraine, Sep. 9-13, 2003, 50 pages.
Semiatin, S.L. et al., "The Thermomechanical Processing of Alpha/Beta Titanium Alloys," Journal of Metals, Jun. 1997, pp. 33-39.
Semiatin et al., "Equal Channel Angular Extrusion of Difficult-to-Work Alloys", Materials & Design, Elsevier Science Ltd., 21, 2000, pp. 311-322.
Semiatin et al., "Alpha/Beta Heat Treatment of a Titanium Alloy with a Nonuniform Microstructure", Metallurgical and Materials Transactions A, vol. 38A, Apr. 2007, pp. 910-921.
Shahan et al., "Adiabatic shear bands in titanium and titanium alloys: a critical review", Materials & Design, vol. 14, No. 4, 1993, pp. 243-250.
SPS Titanium™ Titanium Fasteners, SPS Technologies Aerospace Fasteners, 2003, 4 pages.
Standard Specification for Wrought Titanium—6Aluminum—4Vanadium Alloy for Surgical Implant Applications (UNS R56400), Designation: F 1472-99, ASTM 1999, pp. 1-4.
Takemoto Y et al., "Tensile Behavior and Cold Workability of Ti-Mo Alloys", Materials Transactions Japan Inst. Metals Japan, vol. 45, No. 5, May 2004, pp. 1571-1576.
Tamarisakandala, S. et al., "Strain-induced Porosity During Cogging of Extra-Low Interstitial Grade Ti-6Al-4V", Journal of Materials Engineering and Performance, vol. 10(2), Apr. 2001, pp. 125-130.
Tamirisakandala et al., "Effect of boron on the beta transus of Ti-6Al-4V alloy", Scripta Materialia, 53, 2005, pp. 217-222.
Tamirisakandala et al., "Powder Metallurgy Ti-6Al-4V-xB Alloys: Processing, Microstructure, and Properties", JOM, May 2004, pp. 60-63.
Tebbe, Patrick A. and Ghassan T. Kridli, "Warm forming aluminum alloys: an overview and future directions", Int. J. Materials and Product Technology, vol. 21, Nos. 1-3, 2004, pp. 24-40.
Technical Presentation: Overview of MMPDS Characterization of ATI 425 Alloy, 2012, 1 page.
Timet 6-6-2 Titanium Alloy (Ti-6Al-6V-2Sn), Annealed, accessed Jun. 27, 2012.
Timet Timetal® 6-2-4-2 (Ti-6Al-2Sn-4Zr-2Mo-0.08Si) Titanium Alloy datasheet, accessed Jun. 26, 2012.
Timet Timetal® 6-2-4-6 Titanium Alloy (Ti-6Al-2Sn-4Zr-6Mo), Typical, accessed Jun. 26, 2012.
Tokaji, Keiro et al., "The Microstructure Dependence of Fatigue Behavior in Ti-15Mo-5Zr-3Al Alloy," Materials Science and Engineering A., vol. 213 (1996) pp. 86-92.
Two new α-β titanium alloys, KS Ti-9 for sheet and KS EL-F for forging, with mechanical properties comparable to Ti-6Al-4V, Oct. 8, 2002, ITA 2002 Conference in Orlando, Hideto Oyama, Titanium Technology Dept., Kobe Steel, Ltd., 16 pages.
Veeck, S., et al., "The Castability of Ti-5553 Alloy," Advanced Materials and Processes, Oct. 2004, pp. 47-49.
Weiss, I. et al., "The Processing Window Concept of Beta Titanium Alloys", Recrystallization '90, ed. By T. Chandra, The Minerals, Metals & Materials Society, 1990, pp. 609-616.
Weiss, I. et al., "Thermomechanical Processing of Beta Titanium Alloys—An Overview," Material Science and Engineering, A243, 1998, pp. 46-65.
Williams, J., Thermo-mechanical processing of high-performance Ti alloys: recent progress and future needs, Journal of Material Processing Technology, 117 (2001), p. 370-373.
Zardiackas, L.D. et al., "Stress Corrosion Cracking Resistance of Titanium Implant Materials," Transactions of the 27th Annual Meeting of the Society for Biomaterials, (2001).
Zeng et al., Evaluation of Newly Developed Ti-555 High Strength Titanium Fasteners, 17th AeroMat Conference & Exposition, May 18, 2006, 2 pages.
Zhang et al., "Simulation of slip band evolution in duplex Ti-6Al-4V", Acta Materialia, vol. 58, (2010), Nov. 26, 2009, pp. 1087-1096.
Zherebtsov et al., "Production of submicrocrystalline structure in large-scale Ti-6Al-4V billet by warm severe deformation processing", Scripta Materialia, 51, 2004, pp. 1147-1151.
Titanium Alloy, Sheet, Strip, and Plate 4Al-2.5V-1.5Fe, Annealed, AMS6946 Rev. B, Aug. 2010, SAE Aerospace, Aerospace Material Specification, 7 pages.
Titanium Alloy, Sheet, Strip, and Plate 6Al-4V, Annealed, AMS 4911L, Jun. 2007, SAE Aerospace, Aerospace Material Specification, 7 pages.
Office Action mailed Oct. 19, 2011 in U.S. Appl. No. 12/691,952.
Office Action mailed Feb. 2, 2012 in U.S. Appl. No. 12/691,952.
Office Action mailed Feb. 20, 2004 in U.S. Appl. No. 10/165,348.
Office Action mailed Oct. 26, 2004 in U.S. Appl. No. 10/165,348.
Office Action mailed Feb. 16, 2005 in U.S. Appl. No. 10/165,348.
Office Action mailed Jul. 25, 2005 in U.S. Appl. No. 10/165,348.
Office Action mailed Jan. 3, 2006 in U.S. Appl. No. 10/165,348.
Office Action mailed Dec. 16, 2004 in U.S. Appl. No. 10/434,598.
Office Action mailed Aug. 17, 2005 in U.S. Appl. No. 10/434,598.
Office Action mailed Dec. 19, 2005 in U.S. Appl. No. 10/434,598.
Office Action mailed Sep. 6, 2006 in U.S. Appl. No. 10/434,598.
Office Action mailed Aug. 6, 2008 in U.S. Appl. No. 11/448,160.
Office Action mailed Jan. 13, 2009 in U.S. Appl. No. 11/448,160.
Notice of Allowance mailed Apr. 13, 2010 in U.S. Appl. No. 11/448,160.
Notice of Allowance mailed Sep. 20, 2010 in U.S. Appl. No. 11/448,160.
Office Action mailed Sep. 26, 2007 in U.S. Appl. No. 11/057,614.
Office Action mailed Jan. 10, 2008 in U.S. Appl. No. 11/057,614.
Office Action mailed Aug. 29, 2008 in U.S. Appl. No. 11/057,614.
Office Action mailed Aug. 11, 2009 in U.S. Appl. No. 11/057,614.
Office Action mailed Jan. 14, 2010 in U.S. Appl. No. 11/057,614.
Interview summary mailed Apr. 14, 2010 in U.S. Appl. No. 11/057,614.
Office Action mailed Jun. 21, 2010 in U.S. Appl. No. 11/057,614.
Notice of Allowance mailed Sep. 3, 2010 in U.S. Appl. No. 11/057,614.
Office Action mailed Apr. 1, 2010 in U.S. Appl. No. 11/745,189.
Interview summary mailed Jun. 3, 2010 in U.S. Appl. No. 11/745,189.
Interview summary mailed Jun. 15, 2010 in U.S. Appl. No. 11/745,189.
Office Action mailed Nov. 24, 2010 in U.S. Appl. No. 11/745,189.
Interview summary mailed Jan. 6, 2011 in U.S. Appl. No. 11/745,189.

(56) References Cited

OTHER PUBLICATIONS

Notice of Allowance mailed Jun. 27, 2011 in U.S. Appl. No. 11/745,189.
Office Action mailed Jan. 11, 2011 in U.S. Appl. No. 12/911,947.
Office Action mailed Aug. 4, 2011 in U.S. Appl. No. 12/911,947.
Office Action mailed Nov. 16, 2011 in U.S. Appl. No. 12/911,947.
Advisory Action mailed Jan. 25, 2012 in U.S. Appl. No. 12/911,947.
Notice of Panel Decision from Pre-Appeal Brief Review mailed Mar. 28, 2012 in U.S. Appl. No. 12/911,947.
Office Action mailed Apr. 5, 2012 in U.S. Appl. No. 12/911,947.
Office Action mailed Sep. 19, 2012 in U.S. Appl. No. 12/911,947.
Advisory Action mailed Nov. 29, 2012 in U.S. Appl. No. 12/911,947.
Office Action mailed May 31, 2013 in U.S. Appl. No. 12/911,947.
Office Action mailed Jan. 3, 2011 in U.S. Appl. No. 12/857,789.
Office Action mailed Jul. 27, 2011 in U.S. Appl. No. 12/857,789.
Advisory Action mailed Oct. 7, 2011 in U.S. Appl. No. 12/857,789.
Notice of Allowance mailed Jul. 1, 2013 in U.S. Appl. No. 12/857,789.
Office Action mailed Nov. 14, 2012 in U.S. Appl. No. 12/885,620.
Office Action mailed Jun. 13, 2013 in U.S. Appl. No. 12/885,620.
Office Action mailed Nov. 14, 2012 in U.S. Appl. No. 12/888,699.
Office Action mailed Oct. 3, 2012 in U.S. Appl. No. 12/838,674.
Office Action mailed Jul. 18, 2013 in U.S. Appl. No. 12/838,674.
Office Action mailed Sep. 26, 2012 in U.S. Appl. No. 12/845,122.
Notice of Allowance mailed Apr. 17, 2013 in U.S. Appl. No. 12/845,122.
Office Action mailed Dec. 24, 2012 in U.S. Appl. No. 13/230,046.
Notice of Allowance mailed Jul. 31, 2013 in U.S. Appl. No. 13/230,046.
Office Action mailed Dec. 26, 2012 in U.S. Appl. No. 13/230,143.
Notice of Allowance mailed Aug. 2, 2013 in U.S. Appl. No. 13/230,143.
Office Action mailed Mar. 1, 2013 in U.S. Appl. No. 12/903,851.
Office Action mailed Mar. 25, 2013 in U.S. Appl. No. 13/108,045.
Office Action mailed Apr. 16, 2013 in U.S. Appl. No. 13/150,494.
Office Action mailed Jun. 14, 2013 in U.S. Appl. No. 13/150,494.
U.S. Appl. No. 13/777,066, filed on Feb. 26, 2013.
U.S. Appl. No. 13/331,135, filed on Dec. 20, 2011.
U.S. Appl. No. 13/844,196, filed on Mar. 15, 2013.
U.S. Appl. No. 13/844,545, filed on Mar. 15, 2013.
Office Action mailed Jan. 23, 2013 in U.S. Appl. No. 12/882,538.
Office Action mailed Feb. 8, 2013 in U.S. Appl. No. 12/882,538.
Notice of Allowance mailed Jun. 24, 2013 in U.S. Appl. No. 12/882,538.
Notice of Allowance mailed Oct. 4, 2013 in U.S. Appl. No. 12/911,947.
Notice of Allowance mailed Nov. 5, 2013 in U.S. Appl. No. 13/150,494.
U.S. Appl. No. 13/933,222, filed on Mar. 15, 2013.
Office Action mailed Sep. 6, 2013 in U.S. Appl. No. 13/933,222.
Notice of Allowance mailed Oct. 1, 2013 in U.S. Appl. No. 13/933,222.
U.S. Appl. No. 14/077,699, filed on Nov. 12, 2013.
E112-12 Standard Test Methods for Determining Average Grain Size, ASTM International, Jan. 2013, 27 pages.
ATI Datalloy 2 Alloy, Technical Data Sheet, ATI Properties, Inc., Version 1, Jan. 24, 2013, 6 pages.
ATI AL-6XN® Alloy (UNS N08367), ATI Allegheny Ludlum, 2010, 59 pages.
ATI 800™/ATI 800H™/ATI 800AT™ ATI Technical Data Sheet, Nickel-base Alloys (UNS N08800/N08810/N08811), 2012 Allegheny Technologies Incorporated, Version 1, Mar. 9, 2012, 7 pages.
ATI 825™ Technical Data Sheet, Nickel-base Alloy (UNS N08825), 2013 Allegheny Technologies Incorporated, Version 2, Mar. 8, 2013, 5 pages.
ATI 625™ Alloy Technical Data Sheet, High Strength Nickel-base Alloy (UNS N06625), Allegheny Technologies Incorporated, Version 1, Mar. 4, 2012, 3 pages.
ATI 600™ Technical Data Sheet, Nickel-base Alloy (UNS N06600), 2012 Allegheny Technologies Incorporated, Version 1, Mar. 19, 2012, 5 pages.
Boyko et al., "Modeling of the Open-Die and Radial Forging Processes for Alloy 718", Superalloys 718, 625 and Various Derivatives: Proceedings of the International Symposium on the Metallurgy and Applications of Superalloys 718, 625 and Various Derivatives, held Jun. 23, 1992, pp. 107-124.
ASTM Designation F 2066/F2066M-13, "Standard Specification for Wrought Titanium-15 Molybdenum Alloy for Surgical Implant Applications (UNS R58150)", Nov. 2013, 6 pages.
Office Action mailed Nov. 19, 2013 in U.S. Appl. No. 12/885,620.
Advisory Action Before the Filing of an Appeal Brief mailed Jan. 30, 2014 in U.S. Appl. No. 12/885,620.
Office Action mailed Jun. 18, 2014 in U.S. Appl. No. 12/885,620.
Office Action mailed Jan. 16, 2014 in U.S. Appl. No. 12/903,851.
Office Action mailed Jan. 17, 2014 in U.S. Appl. No. 13/108,045.
Supplemental Notice of Allowability mailed Jan. 17, 2014 in U.S. Appl. No. 13/150,494.
Notice of Allowance mailed May 6, 2014 in U.S. Appl. No. 13/933,222.
ATI 38-644™ Beta Titanium Alloy Technical Data Sheet, UNS R58640, Version 1, Dec. 21, 2011, 4 pages.
All 425® Alloy, Grade 38, Titanium Alloy, UNS R54250, Technical Data Sheet, Version 1, Nov. 25, 2013, pp. 1-6.
Beal et al., "Forming of Titanium and Titanium Alloys-Cold Forming", ASM Handbook, 2006, ASM International, Revised by ASM Committee on Forming Titanium Alloys, vol. 148, 2 pages.
Beal et al., "Forming of Titanium and Titanium Alloys-Cold Forming", ASM Handbook, 2006, vol. 14B, pp. 656-669.
Craighead et al., "Temary Alloys of Titanium", Journal of Metals, Mar. 1950, Transactions AIME, vol. 188, pp. 514-538.
Craighead et al., "Titanium Binary Alloys", Journal of Metals, Mar. 1950, Transactions AIME, vol. 188, pp. 485-513.
Diderrich et al., "Addition of Cobalt to the Ti-6Al-4V Alloy", Journal of Metals, May 1968, pp. 29-37.
Donachie Jr., M.J., "Heat Treating Titanium and Its Alloys", Heat Treating Process, Jun./Jul. 2001, pp. 47-49, 52-53, and 56-57.
Hsieh, Chih-Chun and Weite Wu, "Overview of Intermetallic Sigma Phase Precipitation in Stainless Steels", ISRN Metallurgy, vol. 2012, 2012, pp. 1-16.
Swann, P.R. and J. G. Parr, "Phase Transformations in Titanium-Rich Alloys of Titanium and Cobalt", Transactions of the Metallurgical Society of AIME, Apr. 1958, pp. 276-279.
Yakymyshyn et al., "The Relationship between the Constitution and Mechanical Properties of Titanium-Rich Alloys of Titanium and Cobalt", 1961, vol. 53, pp. 283-294.
Bar definition, ASM Materials Engineering Dictionary, J.R. Davis Ed., ASM International, Materials Park, OH (1992) p. 32.
Billet definition, ASM Materials Engineering Dictionary, J.R. Davis Ed., ASM International, Materials Park, OH (1992) p. 40.
Cogging definition, ASM Materials Engineering Dictionary, J.R. Davis Ed., ASM International, Materials Park, OH (1992) p. 79.
Open die press forging definition, ASM Materials Engineering Dictionary, J.R. Davis Ed., ASM International, Materials Park, OH (1992) pp. 298 and 343.
Thermomechanical working definition, ASM Materials Engineering Dictionary, J.R. Davis Ed., ASM International, Materials Park, OH(1992) p. 480.
Ductility definition, ASM Materials Engineering Dictionary, J.R. Davis Ed., ASM International, Materials Park, OH (1992) p. 131.
AFML-TR-76-80 Development of Titanium Alloy Casting Technology, Aug. 1976, 5 pages.
Office Action mailed Dec. 23, 2014 in U.S. Appl. No. 12/691,952.
Office Action mailed Apr. 23, 2015 U.S. Appl. No. 12/691,952.
Office Action mailed Jul. 28, 2015 in U.S. Appl. No. 12/691,952.
Office Action mailed Nov. 28, 2014 in U.S. Appl. No. 12/885,620.
Advisory Action mailed May 18, 2015 in U.S. Appl. No. 12/885,620.
Office Action mailed Jun. 30, 2015 in U.S. Appl. No. 12/885,620.
Office Action mailed May 27, 2015 in U.S. Appl. No. 12/838,674.

(56) References Cited

OTHER PUBLICATIONS

Applicant Initiated Interview Summary mailed Sep. 1, 2015 in U.S. Appl. No. 12/838,674.
Office Action mailed Oct. 6, 2014 in U.S. Appl. No. 12/903,851.
Office Action mailed Jul. 15, 2015 in U.S. Appl. No. 12/903,851.
Notice of Allowance mailed Oct. 24, 2014 in U.S. Appl. No. 13/844,545.
Notice of Allowance mailed Feb. 6, 2015 in U.S. Appl. No. 13/844,545.
U.S. Appl. No. 14/594,300, filed on Jan. 12, 2015.
Office Action mailed Jun. 3, 2015 in U.S. Appl. No. 13/714,465.
Office Action mailed Jul. 8, 2015 in U.S. Appl. No. 13/714,465.
Office Action mailed Jun. 26, 2015 in U.S. Appl. No. 13/777,066.
Office Action mailed Aug. 19, 2015 in U.S. Appl. No. 13/844,196.

* cited by examiner

THERMOMECHANICAL PROCESSING OF HIGH STRENGTH NON-MAGNETIC CORROSION RESISTANT MATERIAL

BACKGROUND OF THE TECHNOLOGY

1. Field of the Technology

The present disclosure relates to methods of processing high strength, non-magnetic corrosion resistant alloys. The present methods may find application in, for example, and without limitation, the processing of alloys for use in the chemical, mining, oil, and gas industries. The present invention also relates to alloys made by methods including the processing discussed herein.

2. Description of the Background of the Technology

Metal alloy parts used in chemical processing facilities may be in contact with highly corrosive and/or erosive compounds under demanding conditions. These conditions may subject metal alloy parts to high stresses and aggressively promote corrosion and erosion, for example. If it is necessary to replace damaged, worn, or corroded metallic parts of chemical processing equipment, it may be necessary to suspend facility operations for a period of time. Therefore, extending the useful service life of metal alloy parts used in chemical processing facilities can reduce product cost. Service life may be extended, for example, by improving mechanical properties and/or corrosion resistance of the alloys.

Similarly, in oil and gas drilling operations, drill string components may degrade due to mechanical, chemical, and/or environmental conditions. The drill string components may be subject to impact, abrasion, friction, heat, wear, erosion, corrosion, and/or deposits. Conventional alloys may suffer from one or more limitations that negatively impact their performance as drill string components. For example, conventional materials may lack sufficient mechanical properties (for example, yield strength, tensile strength, and/or fatigue strength), possess insufficient corrosion resistance (for example, pitting resistance and/or stress corrosion cracking), or lack necessary non-magnetic properties to operate for extended periods in the down-hole environment. Also, the properties of conventional alloys may limit the possible size and shape of the drill string components made from the alloys. These limitations may reduce the service life of the components, complicating and increasing the cost of oil and gas drilling.

It has been discovered that during warm working radial forging of some high strength, non-magnetic materials to develop a preferred strength, there may be an uneven deformation or an uneven amount of strain in the cross-section of the workpiece. The uneven deformation may be manifest, for example, as a difference in hardness and/or tensile properties between the surface and the center of the forging. For example, observed hardness, yield strength, and tensile strength may be greater at the surface than at the center of the forging. These differences are believed to be consistent with differences in the amount of strain developed in different regions of the cross-section of the workpiece during radial forging.

One method for promoting consistent hardness through the cross-section of a forged bar is to use an age hardenable material such as, for example, the nickel-base superalloy Alloy 718 (UNS N07718) in the direct aged or solution treated and aged condition. Other techniques have involved using cold or warm working to impart hardness to the alloy. This particular technique has been used to harden ATI Datalloy 2® alloy (UNS unassigned), which is a high strength, non-magnetic austenitic stainless steel available from Allegheny Technologies Incorporated, Pittsburgh, Pa. USA. The final thermomechanical processing step used to harden ATI Datalloy 2® alloy involves warm working the material at 1075° F. to an approximately 30 percent reduction in cross-sectional area on a radial forge. Another process, which utilizes a high grade alloy steel referred to as "P-750 alloy" (UNS unassigned), sourced from Schoeller-Bleckmann Oilfield Technology, Houston, Tex., is generally disclosed in U.S. Pat. No. 6,764,647, the entire disclosure of which is hereby incorporated by reference. The P-750 alloy is cold worked to about a 6-19 percent reduction in cross-sectional area at temperatures of 680-1094° F. to obtain relatively even hardness through the cross-section of a final 8-inch billet.

Another method for producing a consistent hardness across the cross-section of a worked workpiece is to increase the amount of cold or warm work used to produce a bar from the workpiece. This, however, becomes impractical with bars having finished diameters equal to or greater than 10 inches because the starting size can exceed the practical limits of ingots that can be melted without imparting problematic melt-related defects. It is noted that if the diameter of the starting workpiece is sufficiently small, then the strain gradient can be eliminated, resulting in consistent mechanical properties and hardness profiles across the cross-section of the finished bar.

It would be desirable to develop a thermomechanical process that could be used on high strength, non-magnetic alloy ingots or workpiece of any starting size that produces a relatively consistent amount of strain through the cross-section of a bar or other mill product produced by the process. Producing a relatively constant strain profile across the cross-section of the worked bar also may result in generally consistent mechanical properties across the bar's cross-section.

SUMMARY

According to a non-limiting aspect of the present disclosure, a method of processing a non-magnetic alloy workpiece comprises: heating the workpiece to a temperature in a warm working temperature range; open die press forging the workpiece to impart a desired strain to a central region of the workpiece; and radial forging the workpiece to impart a desired strain to a surface region of the workpiece. In certain non-limiting embodiments, the warm working temperature range is a range spanning a temperature that is one-third of the incipient melting temperature of the non-magnetic alloy up to a temperature that is two-thirds of the incipient melting temperature of the non-magnetic alloy. In a non-limiting embodiment, the warm working temperature is any temperature up to the highest temperature at which recrystallization (dynamic or static) does not occur in the non-magnetic alloy.

In certain non-limiting embodiments of the method of processing a non-magnetic alloy workpiece according to the present disclosure, the open die press forging step of the method precedes the radial forging step. In still other non-limiting embodiments of the method of processing a non-magnetic alloy workpiece according to the present disclosure, the radial forging step precedes the open die press forging step.

Non-limiting examples of non-magnetic alloys that may be processed by embodiments of methods according to the present disclosure include non-magnetic stainless steel alloys, nickel alloys, cobalt alloys, and iron alloys. In certain non-limiting embodiments, a non-magnetic austenitic stainless steel alloy is processed using embodiments of methods according to the present disclosure.

In certain non-limiting embodiments of a method according to the present disclosure, after the steps of open die press forging and radial forging, the central region strain and the surface region strain are each in a final range of from 0.3 inch/inch up to 1.0 inch/inch, with a difference in strain from the central region to the surface region of not more than 0.5 inch/inch. In a certain non-limiting embodiment of a method according to the present disclosure, after the steps of open die press forging and radial forging, the central region strain and the surface region strain are each in a final range of from 0.3 inch/inch to 0.8 inch/inch. In other non-limiting embodiments, after the steps of open die press forging and radial forging, the surface region strain is substantially equivalent to the central region strain and the workpiece exhibits at least one substantially uniform mechanical property throughout the workpiece cross-section.

According to another aspect of the present disclosure, certain non-limiting embodiments of a method of processing a non-magnetic austenitic stainless steel alloy workpiece comprise: heating the workpiece to a temperature in the range of from 950° F. to 1150° F.; open die press forging the workpiece to impart a final strain in the range of from 0.3 inch/inch up to 1.0 inch/inch to a central region of the workpiece; and radial forging the workpiece to impart a final strain in the range of from 0.3 inch/inch up to 1.0 inch/inch to a surface region of the workpiece, with a difference in strain from the central region to the surface region of not more than 0.5 inch/inch. In a certain non-limiting embodiment, the method includes: open die press forging the workpiece to impart a final strain in the range of from 0.3 inch/inch to 0.8 inch/inch.

In a non-limiting embodiment, the open die press forging step precedes the radial forging step. In another non-limiting embodiment, the radial forging step precedes the open die press forging step.

Another aspect according to the present disclosure is directed to non-magnetic alloy forgings. In certain non-limiting embodiments according to the present disclosure, a non-magnetic alloy forging comprises a circular cross-section having a diameter greater than 5.25 inches, and wherein at least one mechanical property of the non-magnetic alloy forging is substantially uniform throughout the cross-section of the forging. In certain non-limiting embodiments, the mechanical property that is substantially uniform throughout the cross-section of the forging is at least one of hardness, ultimate tensile strength, yield strength, percent elongation, and percent reduction in area.

In certain non-limiting embodiments, a non-magnetic alloy forging according to the present disclosure comprises one of a non-magnetic stainless steel alloy, a nickel alloy, a cobalt alloy, and an iron alloy. In certain non-limiting embodiments, a non-magnetic alloy forging according to the present disclosure comprises a non-magnetic austenitic stainless steel alloy forging.

BRIEF DESCRIPTION OF THE DRAWINGS

The features and advantages of apparatus and methods described herein may be better understood by reference to the accompanying drawings in which.

Figure 1:
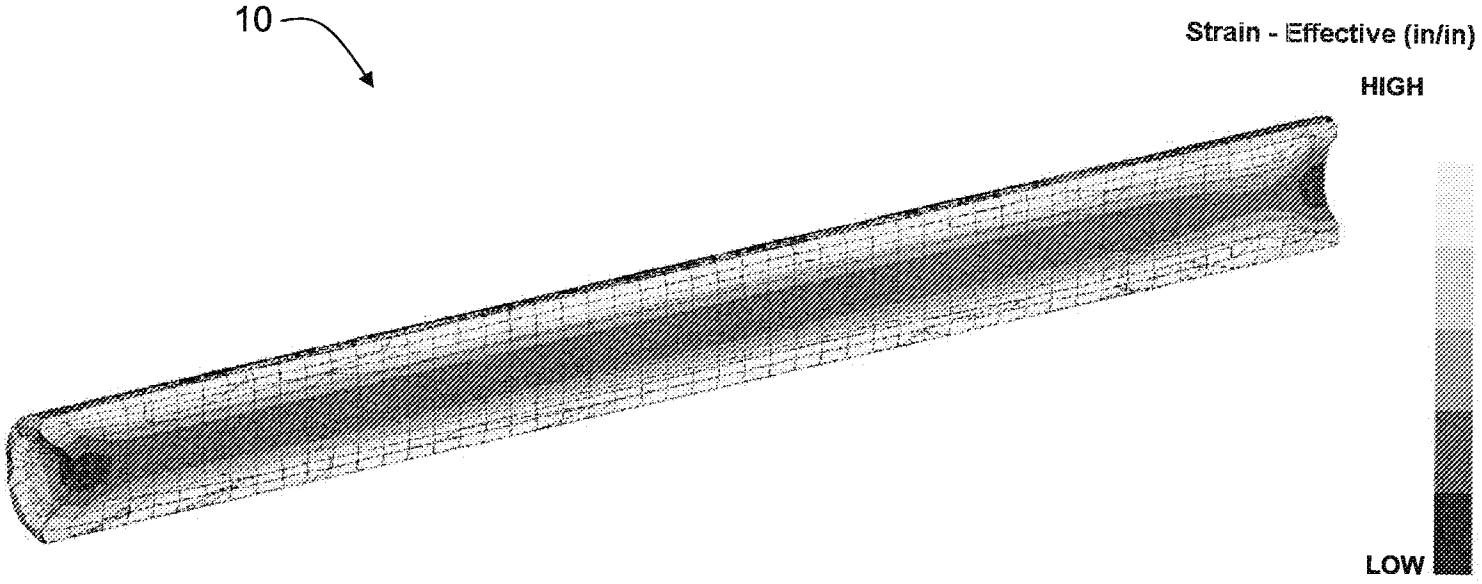
FIG. 1 Prior Art
FIG. 1 shows a simulation of the strain distribution in the cross-section of a workpiece of a non-magnetic alloy workpiece during radial forging.

The reader will appreciate the foregoing details, as well as others, upon considering the following detailed description of certain non-limiting embodiments according to the present disclosure.

DETAILED DESCRIPTION OF CERTAIN NON-LIMITING EMBODIMENTS

It is to be understood that certain descriptions of the embodiments described herein have been simplified to illustrate only those elements, features, and aspects that are relevant to a clear understanding of the disclosed embodiments, while eliminating, for purposes of clarity, other elements, features, and aspects. Persons having ordinary skill in the art, upon considering the present description of the disclosed embodiments, will recognize that other elements and/or features may be desirable in a particular implementation or application of the disclosed embodiments. However, because such other elements and/or features may be readily ascertained and implemented by persons having ordinary skill in the art upon considering the present description of the disclosed embodiments, and are therefore not necessary for a complete understanding of the disclosed embodiments, a description of such elements and/or features is not provided herein. As such, it is to be understood that the description set forth herein is merely exemplary and illustrative of the disclosed embodiments and is not intended to limit the scope of the invention as defined solely by the claims.

Any numerical range recited herein is intended to include all sub-ranges subsumed therein. For example, a range of "1 to 10" or "from 1 to 10" is intended to include all sub-ranges between (and including) the recited minimum value of 1 and the recited maximum value of 10, that is, having a minimum value equal to or greater than 1 and a maximum value of equal to or less than 10. Any maximum numerical limitation recited herein is intended to include all lower numerical limitations subsumed therein and any minimum numerical limitation recited herein is intended to include all higher numerical limitations subsumed therein. Accordingly, Applicants reserve the right to amend the present disclosure, including the claims, to expressly recite any sub-range subsumed within the ranges expressly recited herein. All such ranges are intended to be inherently disclosed herein such that amending to expressly recite any such sub-ranges would comply with the requirements of 35 U.S.C. §112, first paragraph, and 35 U.S.C. §132(a).

The grammatical articles "one", "a", "an", and "the", as used herein, are intended to include "at least one" or "one or more", unless otherwise indicated. Thus, the articles are used herein to refer to one or more than one (i.e., to at least one) of the grammatical objects of the article. By way of example, "a component" means one or more components, and thus, possibly, more than one component is contemplated and may be employed or used in an implementation of the described embodiments.

All percentages and ratios are calculated based on the total weight of the alloy composition, unless otherwise indicated.

Any patent, publication, or other disclosure material that is said to be incorporated, in whole or in part, by reference herein is incorporated herein only to the extent that the incorporated material does not conflict with existing definitions, statements, or other disclosure material set forth in this disclosure. As such, and to the extent necessary, the disclosure as set forth herein supersedes any conflicting material incorporated herein by reference. Any material, or portion thereof, that is said to be incorporated by reference herein, but which conflicts with existing definitions, statements, or other disclosure material set forth herein is only incorporated to the extent that no conflict arises between that incorporated material and the existing disclosure material.

The present disclosure includes descriptions of various embodiments. It is to be understood that all embodiments described herein are exemplary, illustrative, and non-limiting. Thus, the invention is not limited by the description of the various exemplary, illustrative, and non-limiting embodiments. Rather, the invention is defined solely by the claims, which may be amended to recite any features expressly or inherently described in or otherwise expressly or inherently supported by the present disclosure.

As used herein, the terms "forming", "forging", "open die press forging", and "radial forging" refer to forms of thermomechanical processing ("TMP"), which also may be referred to herein as "thermomechanical working". "Thermomechanical working" is defined herein as generally covering a variety of metal forming processes combining controlled thermal and deformation treatments to obtain synergistic effects, such as, for example, and without limitation, improvement in strength, without loss of toughness. This definition of thermomechanical working is consistent with the meaning ascribed in, for example, ASM Materials Engineering Dictionary, J. R. Davis, ed., ASM International (1992), p. 480. "Open die press forging" is defined herein as the forging of metal or metal alloy between dies, in which the material flow is not completely restricted, by mechanical or hydraulic pressure, accompanied with a single work stroke of the press for each die session. This definition of open press die forging is consistent with the meaning ascribed in, for example, ASM Materials Engineering Dictionary, J. R. Davis, ed., ASM International (1992), pp. 298 and 343. "Radial forging" is defined herein as a process using two or more moving anvils or dies for producing forgings with constant or varying diameters along their length. This definition of radial forging is consistent with the meaning ascribed in, for example, ASM Materials Engineering Dictionary, J. R. Davis, ed., ASM International (1992), p. 354. Those having ordinary skill in the metallurgical arts will readily understand the meanings of these several terms.

Conventional alloys used in chemical processing, mining, and/or oil and gas applications may lack an optimal level of corrosion resistance and/or an optimal level of one or more mechanical properties. Various embodiments of alloys processed as described herein may have certain advantages including, but not limited to, improved corrosion resistance and/or mechanical properties over conventionally processed alloys. Certain embodiments of alloys processed as described herein may exhibit one or more improved mechanical properties without any reduction in corrosion resistance, for example. Certain embodiments of alloys processed as described herein may exhibit improved impact properties, weldability, resistance to corrosion fatigue, galling resistance, and/or hydrogen embrittlement resistance relative to certain conventionally processed alloys.

In various embodiments, alloys processed as described herein may exhibit enhanced corrosion resistance and/or advantageous mechanical properties suitable for use in certain demanding applications. Without wishing to be bound to any particular theory, it is believed that certain of the alloys processed as described herein may exhibit higher tensile strength, for example, due to an improved response to strain hardening from deformation, while also retaining high corrosion resistance. Strain hardening or cold or warm working may be used to harden materials that do not generally respond well to heat treatment. However, the exact nature of the cold or warm worked structure may depend on the material, applied strain, strain rate, and/or temperature of the deformation.

The current manufacturing practice for making non-magnetic materials for exploration and drilling applications is to impart a specific amount of warm work into the product as one of the last thermomechanical processing steps. The term "non-magnetic" refers to a material that is not or is only negligibly affected by a magnetic field. Certain non-limiting embodiments of non-magnetic alloys processed as described herein may be characterized by a magnetic permeability value ($\mu_r$) within a particular range. In various non-limiting embodiments, the magnetic permeability value of an alloy processed according to the present disclosure may be less than 1.01, less than 1.005, and/or less than 1.001. In various embodiments, the alloy may be substantially free from ferrite.

The terms "warm working" and "warm work" as used herein refer to thermomechanical working and deformation of a metal or metal alloy by forging at temperatures that are below the lowest temperature at which recrystallization (dynamic or static) occurs in the material. In a non-limiting embodiment, warm working is accomplished in a warm working temperature range that spans a temperature that is one-third of the incipient melting temperature of the alloy up to a temperature that is two-thirds of the incipient melting temperature of the alloy. It will be recognized that the lower limit of the warm working temperature range is only limited to the capabilities of the open die press forge and rotary forge equipment to deform the non-magnetic alloy workpiece at the desired forging temperature. In a non-limiting embodiment, the warm working temperature is any temperature up to the highest temperature at which recrystallization (dynamic or static) does not occur in the non-magnetic alloy. In this embodiment, the term warm working, as-used herein, encompasses and includes working at temperatures that are less than one-third of the incipient melting temperature of the material, including room or ambient temperature and temperatures lower than ambient temperatures. In a non-limiting embodiment, warm working, as used herein, comprises forging a workpiece at a temperature in a range that spans a temperature that is one-third of the incipient melting temperature of the alloy up to a temperature that is two-thirds of the incipient melting temperature of the alloy. In another non-limiting embodiment, the warm working temperature comprises any temperature up to the highest temperature at which recrystallization (dynamic or static) does not occur in the non-magnetic alloy. In this embodiment, the term warm working, as-used herein, encompasses and includes forging at temperatures that are less than one-third of the incipient melting temperature of the material, including room or ambient temperature and temperatures lower than ambient temperatures. The warm working step imparts strength to the alloy workpiece sufficient for the intended application. In the current manufacturing practice, the warm working thermomechanical processing of the alloy is carried out on a radial forge in a single step. In the single radial forging step, the workpiece is warm worked from an initial size to a final forged size using multiple passes on the radial forge, without removing the workpiece from the forging apparatus, and without annealing treatments intermediate the forging passes of the single step.

The present inventors have discovered that during warm work radial forging of high strength non-magnetic austenitic materials to develop a desired strength, it is often the case that the workpiece is deformed unevenly and/or the amount of strain imparted to the workpiece is not uniform across the workpiece cross-section. The uneven deformation may be observed as a difference in hardness and tensile properties between the surface and the center of the workpiece. Hardness, yield strength, and tensile strength were generally observed to be greater at the workpiece surface than at the workpiece center. These differences are believed to be consistent with differences in the amount of strain developed in different regions of the cross-section of the workpiece during radial forging. Differences in mechanical properties and hardness between the surface and central regions of warm worked radial forged-only alloy workpieces may be seen in the test data presented in Table 1. All test samples were non-magnetic austenitic stainless steels, and the chemical composition of each heat is provided in Table 2 below. All test samples listed in Table 1 were warm worked radial forged at 1025° F. as the last thermomechanical processing step applied to the samples before measuring the properties listed in Table 1.

TABLE 1

(Prior Art)

| Heat No. | Final Anneal and Forge Steps | Direction and Test Region | Total Deformation (percent) | Final Diameter (inch) | Yield Strength (ksi) | Ultimate Tensile Strength (ksi) | Percent Elongation | Percent Reduction in Area |
|---|---|---|---|---|---|---|---|---|
| 47FJ-1 | no anneal; radial forge at 1025° F. | Long-MR | 35 | 7.25 | 152.4 | 169.6 | 32.6 | 70.0 |
| | | Transverse | 35 | 7.25 | 127.6 | 148.4 | 28.5 | 57.5 |
| 49FJ-2 | no anneal; radial forge at 1025° F. | Long-MR | 35 | 7.25 | 167.7 | 183.2 | 23.8 | 71.8 |
| | | Transverse | 35 | 7.25 | 114.8 | 140.1 | 26.9 | 61.0 |
| 47FJ-1,2 | annealed at 2150° F.; water quench; radial forge at 1025° F. | Long-MR | 45 | 7.25 | 172.7 | 188.9 | 18.0 | 62.5 |
| | | Transverse | 45 | 7.25 | 140.0 | 153.9 | 18.0 | 50.8 |
| 49FJ-4 | annealed at 2150° F.; water quench; radial forge at 1025° F. | Long-NS | 45 | 7.25 | 156.9 | 170.1 | 30.6 | 67.3 |
| | | Transverse | 45 | 7.25 | 148.1 | 161.9 | 28.8 | 58.8 |
| | | Long-C | | | | | | |
| 01FM-1 | annealed at 2150° F.; water quench; radial forge at 1025° F. to 7.5 inch; reheat 1025° F.; radial forge at 1025° F. to 5.25 inch | Long-NS | 72 | 5.25 | 182.2 | 200.6 | 23.4 | 62.7 |
| | | Long-C | 72 | 5.25 | 201.3 | 214.0 | 19.8 | 52.1 |

key:

Long-MR = long mid-radius; surface region

Transverse = Transverse, specimen gauge length across central region

Long-NS = Longitudinal near surface region

Long-C = long center; central region

FIG. 1 shows a computer-generated simulation prepared using commercially available differential finite element software that simulates thermomechanical working of metals. Specifically, FIG. 1 shows a simulation 10 of the strain distribution in the cross-section of a rod-shaped workpiece of a nickel alloy after radial forging as a final processing step. FIG. 1 is presented herein simply to illustrate a non-limiting embodiment of the present method wherein a combination of press forging and rotary forging is used to equalize or approximate certain properties (for example, hardness and/or mechanical properties) across the cross-section of the warm worked material. FIG. 1 shows that there is considerably greater strain in the surface region of the radial forged workpiece than at the central region of the radial forged workpiece. As such, the strain in the radial forged workpiece differs through the workpiece cross-section, with the strain being greater in the surface region than in the central region.

Figure 2:
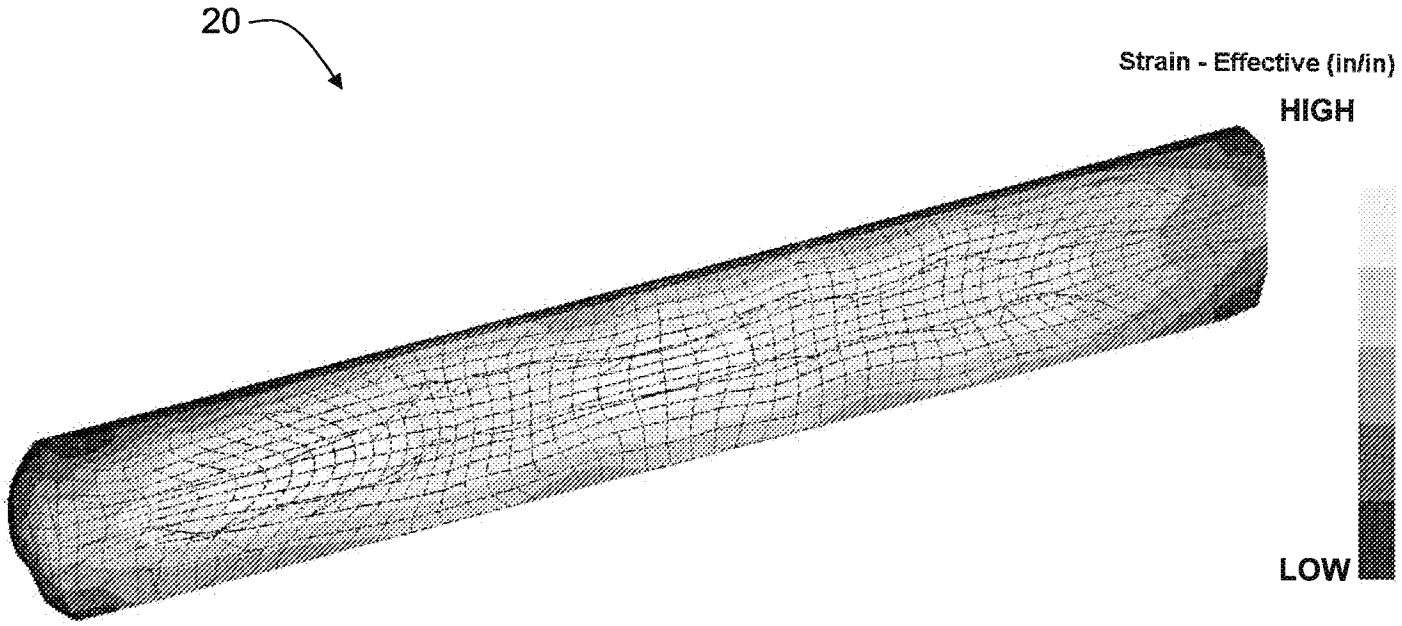
FIG. 2 Prior Art
FIG. 2 shows a simulation of the strain distribution in the cross-section of a workpiece of a non-magnetic alloy during an open die press forging operation.

An aspect of the present disclosure is directed to modifying a conventional method of processing a non-magnetic alloy workpiece including warm work radial forging as the last thermomechanical step, so as to include a warm working open die press forging step. FIG. 2 shows a computer-generated simulation 20 of the strain distribution in a cross-section of a nickel alloy workpiece after an open die press forging operation. The strain distribution produced after open die press forging is generally the reverse of the strain distribution produced after the radial forging operation illustrated in FIG. 1. FIG. 2 shows that there is generally greater strain in the central region of the open die press forged workpiece than in the surface region of the open die press forged workpiece. As such, the strain in the open die press forged workpiece differs through the workpiece cross-section, with the strain being greater in the central region than in the surface region.

Figure 3:
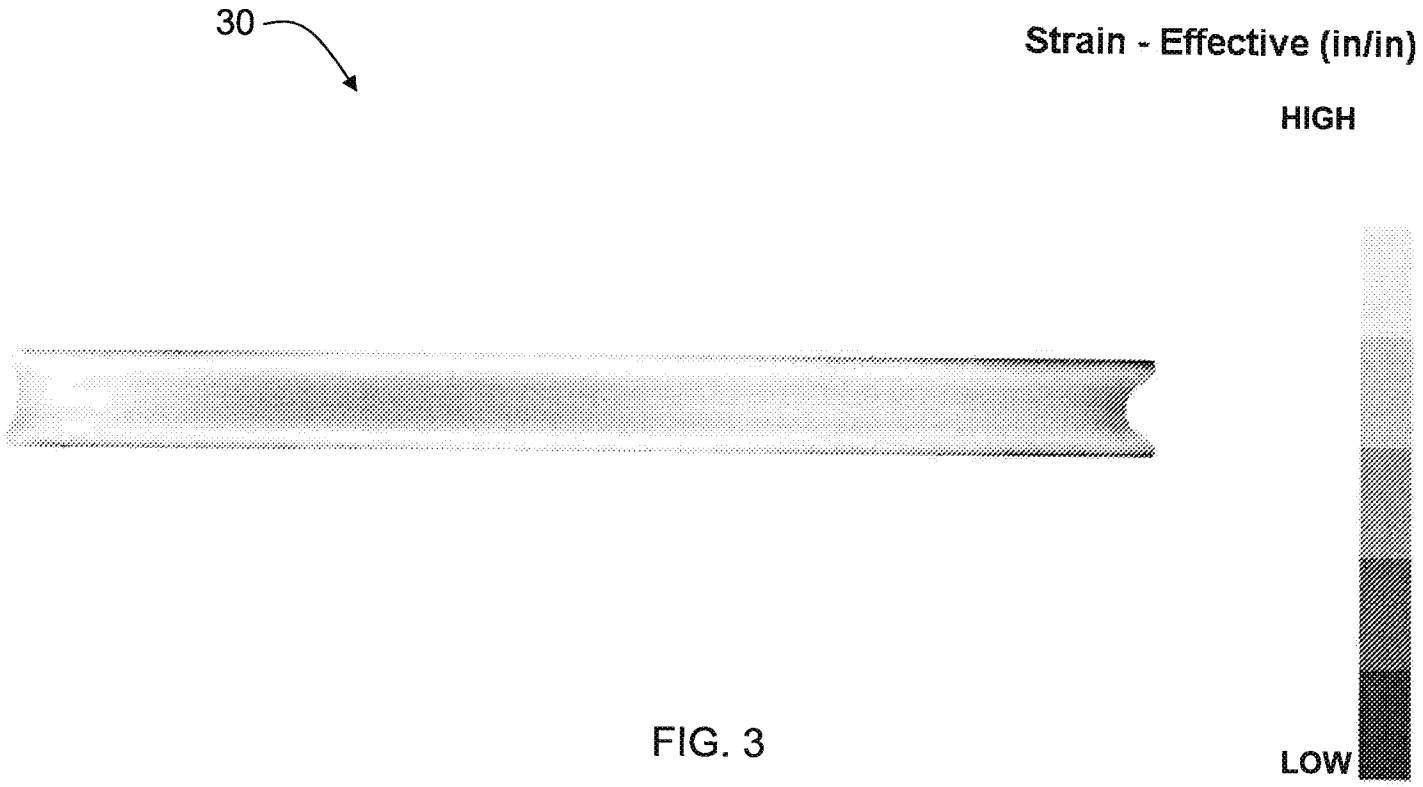
FIG. 3 shows a simulation of the strain distribution in a workpiece processed by a non-limiting embodiment of a method according to the present disclosure including a warm work open die press forging step and a warm work radial forging step.

FIG. 3. of the present disclosure shows a computer-generated simulation 30 of strain distribution across a workpiece cross-section illustrating aspects of certain non-limiting embodiments of a method according to the present disclosure. The simulation shown in FIG. 3 illustrates strain produced in the cross-section of a nickel alloy workpiece by a thermomechanical working process including a warm work open die press forging step and a warm work radial forging step. It is observed from FIG. 3 that the distribution of strain predicted from the process is substantially uniform over the cross-section of the workpiece. Thus, a process including a warm work open die press forging step and a warm work radial forging step can produce a forged article in which strain is generally the same in a central region and in a surface region of the forged article.

Figure 4:
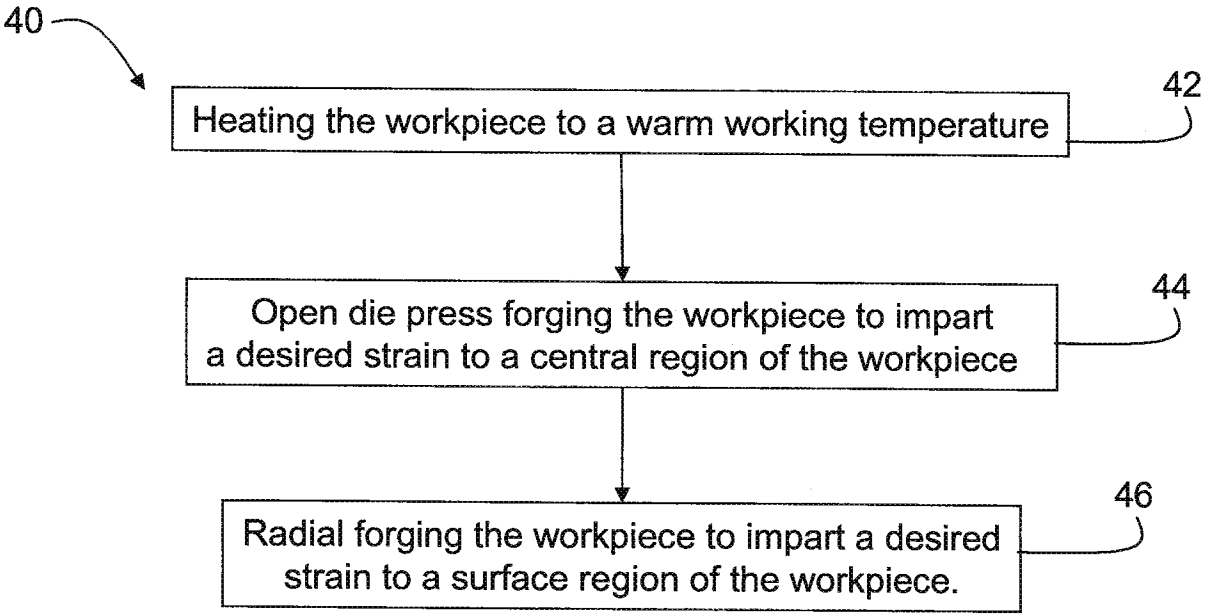
FIG. 4 is a flow chart illustrating aspects of a method of processing a non-magnetic alloy according to a non-limiting embodiment of the present disclosure.

Referring to FIG. 4, according to an aspect of the present disclosure, a non-limiting method 40 for processing a non-magnetic alloy workpiece comprises heating 42 the workpiece to a temperature in a warm working temperature range, open die press forging 44 the workpiece to impart a desired strain to a central region of the workpiece. In a non-limiting embodiment, the workpiece is open die press forged to impart a desired strain in the central region in a range of 0.3 inch/inch to 1.0 inch per inch. In another non-limiting embodiment, the workpiece is open die press forged to impart a desired strain in the central region in a range of 0.3 inch/inch to 0.8 inch per inch.

The workpiece is then radial forged 46 to impart a desired strain to a surface region of the workpiece. In a non-limiting embodiment, the workpiece is radial forged to impart a desired strain in the surface region in a range of 0.3 inch/inch to 1.0 inch per inch. In another non-limiting embodiment, the workpiece is radial forged to impart a desired strain in the surface region in a range of 0.3 inch/inch to 0.8 inch per inch.

In a non-limiting embodiment, after open die press forging and radial forging, the strain imparted to the central region and the strain imparted to the surface region are each in a range of from 0.3 inch/inch to 1.0 inch/inch, and the difference in strain from the central region to the surface region is not more than 0.5 inch/inch. In another non-limiting embodiment after the steps of open die press forging and radial forging, the strain imparted to the central region and the strain imparted to the surface region are each in a range of from 0.3 inch/inch to 0.8 inch/inch. Ordinary skilled practitioners know or will be able to easily determine open die press forging and radial forging parameters required to achieve the desired respective strains, and operating parameters of individual forging steps need not be discussed herein.

In certain non-limiting embodiments, a "surface region" of a workpiece includes a volume of material between the surface of the workpiece to a depth of about 30 percent of the distance from the surface to the workpiece center. In certain other non-limiting embodiments, a "surface region" of a workpiece includes a volume of material between the surface of the workpiece to a depth of about 40 percent, or in certain embodiments about 50 percent, of the distance from the surface to the workpiece center. It will be apparent to those having ordinary skill as to what constitutes the "center" of a workpiece having a particular shape for purposes of identifying a "surface region". For example, an elongate cylindrical workpiece will have a central longitudinal axis, and the surface region of the workpiece will extend from the outer peripheral curved surface of the workpiece in the direction of the central longitudinal axis. Also for example, an elongate workpiece having a square or rectangular cross-section taken transverse to a longitudinal axis of the workpiece will have four distinct peripheral "faces" a central longitudinal axis, and the surface region of each face will extend from the surface of the face into the workpiece in the general direction of the central axis and the opposing face. Also, for example, a slab-shaped workpiece will have two large primary opposed faces generally equidistant from an intermediate plane within the workpiece, and the surface region of each primary face will extend from the surface of the face into the workpiece toward the intermediate plane and the opposed primary face.

Figure 5:
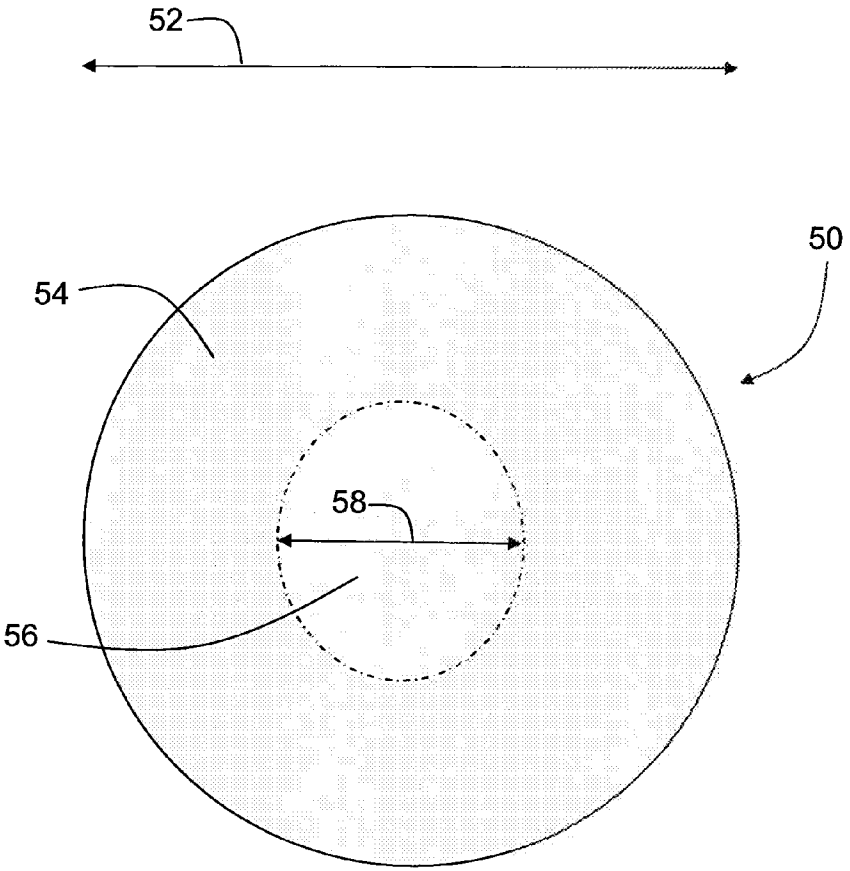
FIG. 5 is a schematic illustration of surface region and central region locations in a workpiece in connection with a non-limiting embodiment according to the present disclosure.

In certain non-limiting embodiments, a "central region" of a workpiece includes a centrally located volume of material that makes up about 70 percent by volume of material of the workpiece. In certain other non-limiting embodiments, a "central region" of a workpiece includes a centrally located volume of material that makes up about 60 percent, or about 50 percent, by volume of the material of the workpiece. FIG. 5 schematically illustrates a not drawn to scale cross-section of an elongate cylindrical forged bar 50, wherein the section is taken at 90 degrees to the central axis of the workpiece. According to a non-limiting embodiment of the present disclosure in which the diameter 52 of forged bar 50 is about 12 inches, the surface region 56 and the central region 58 each comprise about 50 volume percent of the material in the cross-section (and in the workpiece), and wherein the diameter of the central region is about 4.24 inches.

In another non-limiting embodiment of the method, after the open die press forging and radial forging steps, strain within a surface region of the workpiece is substantially equivalent to strain within a central region of the workpiece. As used herein, strain within a surface region of the workpiece is "substantially equivalent" to strain within a central region of the workpiece when strain between the regions differs by less than 20%, or by less than 15%, or less than 5%. The combined use of open die press forging and radial forging in embodiments of the method according to the present disclosure can produce a workpiece with strain that is substantially equivalent throughout the cross-section of a final forged workpiece. A consequence of the strain distribution in such forged workpieces is that the workpieces may have one or more mechanical properties that are substantially uniform, through the workpiece cross-section and/or as between a surface region and a central region of the workpiece. As used herein, one or more mechanical properties within a surface region of the workpiece are "substantially uniform" to one or more properties within a central region of the workpiece when one or more mechanical properties between the regions differs by less than 20%, or by less than 15%, or less than 5%.

It is not believed to be critical to the strain distribution and subsequent mechanical properties whether the warm work open die press forging step 44 or the warm work radial forging step 46 is conducted first. In certain non-limiting embodiments, the open die press forging 44 step precedes the radial forging 46 step. In other non-limiting embodiments, the radial forging 46 step precedes the open die press forging 44 step. It will be understood that multiple cycles consisting of an open die press forging step 44 and a radial forging step 46 may be utilized to achieve the desired strain distribution and desired one or more mechanical properties across the cross-section of the final forged article. Multiple cycles, however, involve additional expense. It is believed that it is generally unnecessary to conduct multiple cycles of radial forging and open die press forging steps to achieve an substantially equivalent strain distribution across the cross-section of the workpiece.

In certain non-limiting embodiments of the method according to the present disclosure, the workpiece may be transferred from the first forging apparatus, i.e., one of a radial forge and an open die press forge, directly to the second forging apparatus, i.e., the other of the radial forge and open die press forge. In certain non-limiting embodiments, after the first warm work forging step (i.e., either radial forging or open die press forging), the workpiece may be cooled to room temperature and then reheated to a warm working temperature prior to the second warm work forging step, or alternatively, the workpiece could be directly transferred from the first forging apparatus to a reheat furnace to be reheated for the second warm work forging step.

In non-limiting embodiments, the non-magnetic alloy processed using the method of the present disclosure is a non-magnetic stainless steel alloy. In a certain non-limiting embodiments, the non-magnetic stainless steel alloy processed using the method of the present disclosure is a non-magnetic austenitic stainless steel alloy. In certain non-limiting embodiments, when the method is applied to processing a non-magnetic austenitic stainless steel alloy, the temperature range in which the radial forging and open die press forging steps are conducted is from 950° F. to 1150° F.

In certain non-limiting embodiments, prior to heating the workpiece to the warm working temperature, the workpiece may be annealed or homogenized to facilitate the warm work forging steps. In a non-limiting embodiment, when the workpiece comprises a non-magnetic austenitic stainless steel alloy, the workpiece is annealed at a temperature in the range of 1850° F. to 2300° F., and is heated at the annealing temperature for 1 minute to 10 hours. In certain non-limiting embodiments, heating the workpiece to the warm working temperature comprises allowing the workpiece to cool from the annealing temperature to the warm working temperature. As will be readily apparent to those having ordinary skill, the annealing time necessary to dissolve deleterious sigma precipitates that could form in a particular workpiece during hot working will be dependent on annealing temperature; the higher the annealing temp, the shorter the time needed to dissolve any deleterious sigma precipitate that formed. Ordinarily skilled practitioners will be able to determine suitable annealing temperatures and times for a particular workpiece without undue effort.

It has been noted that when the diameter of a workpiece that has been warm work forged according to the method of the present disclosure is on the order of 5.25 inches or less, a significant difference may not be observed in strain and certain consequent mechanical properties between material in a central region and material in a surface region of the forged workpiece (see Table 1). In certain non-limiting embodiments according to the present disclosure, the forged workpiece that has been processed using the present method is generally cylindrical and comprises a generally circular cross-section. In certain non-limiting embodiments, the forged workpiece that has been processed using the present method is generally cylindrical and comprises a circular cross-section having a diameter that is no greater than 5.25 inches. In certain non-limiting embodiments, the forged workpiece that has been processed using the present method is generally cylindrical and comprises a circular cross-section having a diameter that is greater than 5.25 inches, or is at least 7.25 inches, or is 7.25 inches to 12.0 inches after warm work forging according to the present disclosure.

Another aspect of the present disclosure is directed to a method of processing a non-magnetic austenitic stainless steel alloy workpiece, the method comprising: heating the workpiece to a warm working temperature in a temperature range from 950° F. to 1150° F.; open die press forging the workpiece to impart a final strain of between 0.3 inch/inch to 1.0 inch/inch, or 0.3 inch/inch to 0.8 inch/inch to a central region of the workpiece; and radial forging the workpiece to impart a final strain of between 0.3 inch/inch to 1.0 inch/inch, or 0.3 inch/inch to 0.8 inch/inch to a surface region of the workpiece. In a non-limiting embodiment, after open press die forging and radial forging the workpiece a difference in final strain in the central region and the surface region is no more than 0.5 inch/inch. In other non-limiting embodiment, strain between the regions differs by less than 20%, or by less than 15%, or less than 5%. In non-limiting embodiments of the method, the open die press forging step precedes the radial forging step. In other non-limiting embodiments of the method, the radial forging step precedes the open die press forging step.

The method of processing a non-magnetic austenitic stainless steel alloy workpiece according to the present disclosure may further comprise annealing the workpiece prior to heating the workpiece to the warm working temperature. In a non-limiting embodiment, the non-magnetic austenitic stainless steel alloy workpiece may be annealed at an annealing temperature in a temperature range of 1850° F. to 2300° F., and an annealing time may be in the range of 1 minute to 10 hours. In still another non-limiting embodiment, the step of heating the non-magnetic austenitic stainless steel alloy workpiece to the warm working temperature may comprise allowing the workpiece to cool from the annealing temperature to the warm working temperature.

As discussed above, it has been noted that when the diameter of a workpiece that has been warm work forged according to the method of the present disclosure is on the order of, for example, 5.25 inches or less, a significant difference may not be observed in strain and certain consequent mechanical properties between material in a central region and material in a surface region of the forged workpiece. In certain non-limiting embodiments according to the present disclosure, the forged workpiece that has been processed using the present method is a generally cylindrical non-magnetic austenitic stainless steel alloy workpiece and comprises a generally circular cross-section. In certain non-limiting embodiments, the forged workpiece that has been processed using the present method is a generally cylindrical non-magnetic austenitic stainless steel alloy workpiece and comprises a circular cross-section having a diameter that is no greater than 5.25 inches. In certain non-limiting embodiments, the forged workpiece that has been processed using the present method is a generally cylindrical non-magnetic austenitic stainless steel alloy workpiece and comprises a circular cross-section having a diameter that is greater than 5.25 inches, or is at least 7.25 inches, or is 7.25 inches to 12.0 inches after warm work forging according to the present disclosure.

Still another aspect according to the present disclosure is directed to a non-magnetic alloy forging. In a non-limiting embodiment, a non-magnetic alloy forging according to the present disclosure comprises a circular cross-section with a diameter greater than 5.25 inches. At least one mechanical property of the non-magnetic alloy forging is substantially uniform throughout the cross-section of the forging. In non-limiting embodiments, the substantially uniform mechanical property comprises one or more of a hardness, an ultimate tensile strength, a yield strength, a percent elongation, and a percent reduction in area.

It will be recognized that while non-limiting embodiments of the present disclosure are directed to a method for providing substantially equivalent strain and at least one substantially uniform mechanical property across a cross-section of a forged workpiece, the practice of radial forging combined with open press die forging may be used as to impart strain in a central region of a workpiece that differs to a desired degree from strain imparted by the method in a surface region of the workpiece. For example, with reference to FIG. 3, in non-limiting embodiments, after the steps of open die press forging 44 and radial forging 46, the strain in a surface region may intentionally be greater than the strain in a central region of the workpiece. Methods according to the present disclosure wherein relative strains imparted by the method differ in this way may be highly beneficial in minimizing complications in machining of a final part that may arise if hardness and/or mechanical properties vary in different regions of the part. Alternatively, in non-limiting embodiments, after the steps of open die press forging 44 and radial forging 46, the strain in a surface region may intentionally be less than the strain in a central region of the workpiece. Also, in certain non-limiting embodiments of a method according to the present disclosure, after the steps of open die press forging 44 and radial forging 46, the workpiece comprises a gradient of strain from a surface region to a central region of the workpiece. In such case, the imparted strains may increase or decrease as distance from the center of the workpiece increases. Methods according to the present disclosure wherein a gradient of strain is imparted to a final forged workpiece may be advantageous in various applications.

In various non-limiting embodiments, a non-magnetic alloy forging according to the present disclosure may be selected from a non-magnetic stainless steel alloy, a nickel alloy, a cobalt alloy, and an iron alloy. In certain non-limiting embodiments, a non-magnetic alloy forging according to the present disclosure comprises a non-magnetic austenitic stainless steel alloy.

A broad chemical composition of one high strength non-magnetic austenitic stainless steel intended for exploration and production drilling applications in the oil and gas industry that may be processed by a method and embodied in a forged article according to the present disclosure is disclosed in co-pending U.S. patent application Ser. No. 13/331,135, filed on Dec. 20, 2011, which is incorporated by reference herein in its entirety.

One specific example of a highly corrosion resistant, high strength material for exploration and discovery applications in the oil and gas industry that may be processed by a method and embodied in a forged article according to the present disclosure is AL-6XN® alloy (UNS N08367), which is an iron-base austenitic stainless steel alloy available from Allegheny Technologies Incorporated, Pittsburgh, Pa. USA. A two-step warm work forging process according to the present disclosure can be used for AL-6XN® alloy to impart high strength to the material.

Another specific example of a highly corrosion resistant, high strength material for exploration and discovery applications in the oil and gas industry that may be processed by a method and embodied in a forged article according to the present disclosure is ATI Datalloy 2® alloy (no UNS assigned), a high strength, non-magnetic austenitic stainless steel, which is available from Allegheny Technologies Incorporated, Pittsburgh, Pa. USA. A nominal composition of ATI Datalloy 2® alloy in weight percentages based on the total alloy weight is 0.03 carbon, 0.30 silicon, 15.1 manganese, 15.3 chromium, 2.1 molybdenum, 2.3 nickel, 0.4 nitrogen, remainder iron and incidental impurities.

In certain non-limiting embodiments, an alloy that may be processed by a method and embodied in a forged article according to the present disclosure is an austenitic alloy that comprises, consists essentially of, or consists of chromium, cobalt, copper, iron, manganese, molybdenum, nickel, carbon, nitrogen, tungsten, and incidental impurities. In certain non-limiting embodiments, the austenitic alloy optionally further includes one or more of aluminum, silicon, titanium, boron, phosphorus, sulfur, niobium, tantalum, ruthenium, vanadium, and zirconium, either as trace elements or as incidental impurities.

Also, according to various non-limiting embodiments, an austenitic alloy that may be processed by a method and embodied in a forged article according to the present disclosure comprises, consists essentially of, or consists of, in weight percentages based on total alloy weight, up to 0.2 carbon, up to 20 manganese, 0.1 to 1.0 silicon, 14.0 to 28.0 chromium, 15.0 to 38.0 nickel, 2.0 to 9.0 molybdenum, 0.1 to 3.0 copper, 0.08 to 0.9 nitrogen, 0.1 to 5.0 tungsten, 0.5 to 5.0 cobalt, up to 1.0 titanium, up to 0.05 boron, up to 0.05 phosphorus, up to 0.05 sulfur, iron, and incidental impurities.

In addition, according to various non-limiting embodiments, an austenitic alloy that may be processed by a method and embodied in a forged article according to the present disclosure comprises, consists essentially of, or consists of, in weight percentages based on total alloy weight, up to 0.05 carbon, 1.0 to 9.0 manganese, 0.1 to 1.0 silicon, 18.0 to 26.0 chromium, 19.0 to 37.0 nickel, 3.0 to 7.0 molybdenum, 0.4 to 2.5 copper, 0.1 to 0.55 nitrogen, 0.2 to 3.0 tungsten, 0.8 to 3.5 cobalt, up to 0.6 titanium, a combined weight percentage of columbium and tantalum no greater than 0.3, up to 0.2 vanadium, up to 0.1 aluminum, up to 0.05 boron, up to 0.05 phosphorus, up to 0.05 sulfur, iron, and incidental impurities.

Also, according to various non-limiting embodiments, an austenitic alloy that may be processed by a method and embodied in a forged article according to the present disclosure may comprise, consist essentially of, or consist of, in weight percentages based on total alloy weight, up to 0.05 carbon, 2.0 to 8.0 manganese, 0.1 to 0.5 silicon, 19.0 to 25.0 chromium, 20.0 to 35.0 nickel, 3.0 to 6.5 molybdenum, 0.5 to 2.0 copper, 0.2 to 0.5 nitrogen, 0.3 to 2.5 tungsten, 1.0 to 3.5 cobalt, up to 0.6 titanium, a combined weight percentage of columbium and tantalum no greater than 0.3, up to 0.2 vanadium, up to 0.1 aluminum, up to 0.05 boron, up to 0.05 phosphorus, up to 0.05 sulfur, iron, and incidental impurities.

In various non-limiting embodiments, an austenitic alloy that may be processed by a method and embodied in a forged article according to the present disclosure comprises carbon in any of the following weight percentage ranges: up to 2.0; up to 0.8; up to 0.2; up to 0.08; up to 0.05; up to 0.03; 0.005 to 2.0; 0.01 to 2.0; 0.01 to 1.0; 0.01 to 0.8; 0.01 to 0.08; 0.01 to 0.05; and 0.005 to 0.01.

In various non-limiting embodiments, an austenitic alloy that may be processed by a method and embodied in a forged article according to the present disclosure comprises manganese in any of the following weight percentages: up to 20.0; up to 10.0; 1.0 to 20.0; 1.0 to 10; 1.0 to 9.0; 2.0 to 8.0; 2.0 to 7.0; 2.0 to 6.0; 3.5 to 6.5; and 4.0 to 6.0.

In various non-limiting embodiments, an austenitic alloy that may be processed by a method and embodied in a forged article according to the present disclosure comprises silicon in any of the following weight percentages: up to 1.0; 0.1 to 1.0; 0.5 to 1.0; and 0.1 to 0.5.

In various non-limiting embodiments, an austenitic alloy that may be processed by a method and embodied in a forged article according to the present disclosure comprises chromium in any of the following weight percentage ranges: 14.0 to 28.0; 16.0 to 25.0; 18.0 to 26; 19.0 to 25.0; 20.0 to 24.0; 20.0 to 22.0; 21.0 to 23.0; and 17.0 to 21.0.

In various non-limiting embodiments, an austenitic alloy that may be processed by a method and embodied in a forged article according to the present disclosure comprises nickel in any of the following weight percentage ranges: 15.0 to 38.0; 19.0 to 37.0; 20.0 to 35.0; and 21.0 to 32.0.

In various non-limiting embodiments, an austenitic alloy that may be processed by a method and embodied in a forged article according to the present disclosure comprises molybdenum in any of the following weight percentage ranges: 2.0 to 9.0; 3.0 to 7.0; 3.0 to 6.5; 5.5 to 6.5; and 6.0 to 6.5.

In various non-limiting embodiments, an austenitic alloy that may be processed by a method and embodied in a forged article according to the present disclosure comprises copper in any of the following weight percentage ranges: 0.1 to 3.0; 0.4 to 2.5; 0.5 to 2.0; and 1.0 to 1.5.

In various non-limiting embodiments, an austenitic alloy that may be processed by a method and embodied in a forged article according to the present disclosure comprises nitrogen in any of the following weight percentage ranges: 0.08 to 0.9; 0.08 to 0.3; 0.1 to 0.55; 0.2 to 0.5; and 0.2 to 0.3. In certain embodiments, the nitrogen content in the austenitic alloy may be limited to 0.35 weight percent or 0.3 weight percent to address its limited solubility in the alloy.

In various non-limiting embodiments, an austenitic alloy that may be processed by a method and embodied in a forged article according to the present disclosure comprises tungsten in any of the following weight percentage ranges: 0.1 to 5.0; 0.1 to 1.0; 0.2 to 3.0; 0.2 to 0.8; and 0.3 to 2.5.

In various non-limiting embodiments, an austenitic alloy that may be processed by a method and embodied in a forged article according to the present disclosure comprises cobalt in any of the following weight percentages: up to 5.0; 0.5 to 5.0; 0.5 to 1.0; 0.8 to 3.5; 1.0 to 4.0; 1.0 to 3.5; and 1.0 to 3.0. In certain embodiments of alloys processed by a method and embodied in a forged article according to the present disclosure, cobalt unexpectedly improved mechanical properties of the alloy. For example, in certain embodiments of the alloy, additions of cobalt may provide up to a 20% increase in toughness, up to a 20% increase in elongation, and/or improved corrosion resistance. Without wishing to be bound to any particular theory, it is believed that replacing iron with cobalt may increase the resistance to detrimental sigma phase precipitation in the alloy relative to non-cobalt bearing variants which exhibited higher levels of sigma phase at the grain boundaries after hot working.

In various non-limiting embodiments, an austenitic alloy that may be processed by a method and embodied in a forged article according to the present disclosure comprises cobalt and tungsten in a cobalt/tungsten weight percentage ratio of from 2:1 to 5:1, or from 2:1 to 4:1. In certain embodiments, for example, the cobalt/tungsten weight percentage ratio may be about 4:1. The use of cobalt and tungsten may impart improved solid solution strengthening to the alloy.

In various non-limiting embodiments, an austenitic alloy that may be processed by a method and embodied in a forged article according to the present disclosure comprises titanium in any of the following weight percentages: up to 1.0; up to 0.6; up to 0.1; up to 0.01; 0.005 to 1.0; and 0.1 to 0.6.

In various non-limiting embodiments, an austenitic alloy that may be processed by a method and embodied in a forged article according to the present disclosure comprises zirconium in any of the following weight percentages: up to 1.0; up to 0.6; up to 0.1; up to 0.01; 0.005 to 1.0; and 0.1 to 0.6.

In various non-limiting embodiments, an austenitic alloy that may be processed by a method and embodied in a forged article according to the present disclosure comprises niobium and/or tantalum in any of the following weight percentages: up to 1.0; up to 0.5; up to 0.3; 0.01 to 1.0; 0.01 to 0.5; 0.01 to 0.1; and 0.1 to 0.5.

In various non-limiting embodiments, an austenitic alloy that may be processed by a method and embodied in a forged article according to the present disclosure comprises a combined weight percentage of columbium and tantalum in any of the following ranges: up to 1.0; up to 0.5; up to 0.3; 0.01 to 1.0; 0.01 to 0.5; 0.01 to 0.1; and 0.1 to 0.5.

In various non-limiting embodiments, an austenitic alloy that may be processed by a method and embodied in a forged article according to the present disclosure comprises vanadium in any of the following weight percentages: up to 1.0; up to 0.5; up to 0.2; 0.01 to 1.0; 0.01 to 0.5; 0.05 to 0.2; and 0.1 to 0.5.

In various non-limiting embodiments, an austenitic alloy that may be processed by a method and embodied in a forged article according to the present disclosure comprises aluminum in any of the following weight percentage ranges: up to 1.0; up to 0.5; up to 0.1; up to 0.01; 0.01 to 1.0; 0.1 to 0.5; and 0.05 to 0.1.

In various non-limiting embodiments, an austenitic alloy that may be processed by a method and embodied in a forged article according to the present disclosure comprises boron in any of the following weight percentage ranges: up to 0.05; up to 0.01; up to 0.008; up to 0.001; up to 0.0005.

In various non-limiting embodiments, an austenitic alloy that may be processed by a method and embodied in a forged article according to the present disclosure comprises phosphorus in any of the following weight percentage ranges: up to 0.05; up to 0.025; up to 0.01; and up to 0.005.

In various non-limiting embodiments, an austenitic alloy that may be processed by a method and embodied in a forged article according to the present disclosure comprises sulfur in any of the following weight percentage ranges: up to 0.05; up to 0.025; up to 0.01; and up to 0.005.

In various non-limiting embodiments, the balance of an austenitic alloy that may be processed by a method and embodied in a forged article according to the present disclosure may comprise, consist essentially of, or consist of iron and incidental impurities. In various non-limiting embodiments, In various non-limiting embodiments, an austenitic alloy that may be processed by a method and embodied in a forged article according to the present disclosure comprises iron in any of the following weight percentage ranges: up to 60; up to 50; 20 to 60; 20 to 50; 20 to 45; to 45; 30 to 50; 40 to 60; 40 to 50; 40 to 45; and 50 to 60.

In various non-limiting embodiments, an austenitic alloy processed by a method according to the present disclosure comprises one or more trace elements. As used herein, "trace elements" refers to elements that may be present in the alloy as a result of the composition of the raw materials and/or the melting method employed and which are present in concentrations that do not significantly negatively affect important properties of the alloy, as those properties are generally described herein. Trace elements may include, for example, one or more of titanium, zirconium, columbium (niobium), tantalum, vanadium, aluminum, and boron in any of the concentrations described herein. In certain non-limiting embodiments, trace elements may not be present in alloys according to the present disclosure. As is known in the art, in producing alloys, trace elements typically may be largely or wholly eliminated by selection of particular starting materials and/or use of particular processing techniques. In various non-limiting embodiments, an austenitic alloy that may be processed by a method and embodied in a forged article according to the present disclosure comprises a total concentration of trace elements in any of the following weight percentage ranges: up to 5.0; up to 1.0; up to 0.5; up to 0.1; 0.1 to 5.0; 0.1 to 1.0; and 0.1 to 0.5.

In various non-limiting embodiments, an austenitic alloy that may be processed by a method and embodied in a forged article according to the present disclosure comprises a total concentration of incidental impurities in any of the following weight percentage ranges: up to 5.0; up to 1.0; up to 0.5; up to 0.1; 0.1 to 5.0; 0.1 to 1.0; and 0.1 to 0.5. As generally used herein, the term "incidental impurities" refers elements present in the alloy in minor concentrations. Such elements may include one or more of bismuth, calcium, cerium, lanthanum, lead, oxygen, phosphorus, ruthenium, silver, selenium, sulfur, tellurium, tin and zirconium. In various non-limiting embodiments, individual incidental impurities in an alloy that may be processed by a method and embodied in a forged article according to the present disclosure do not exceed the following maximum weight percentages: 0.0005 bismuth; 0.1 calcium; 0.1 cerium; 0.1 lanthanum; 0.001 lead; 0.01 tin, 0.01 oxygen; 0.5 ruthenium; 0.0005 silver; 0.0005 selenium; and 0.0005 tellurium. In various non-limiting embodiments, an alloy that may be processed by a method and embodied in a forged article according to the present disclosure, the combined weight percentage of cerium, lanthanum, and calcium present in the alloy (if any is present) may be up to 0.1. In various non-limiting embodiments, the combined weight percentage of cerium and/or lanthanum present in the alloy may be up to 0.1. Other elements that may be present as incidental impurities in alloys that may be processed by a method and embodied in a forged article according to the present disclosure will be apparent to those having ordinary skill in the art upon considering the present disclosure. In various non-limiting embodiments, an austenitic alloy that may be processed by a method and embodied in a forged article according to the present disclosure comprises a total concentration of trace elements and incidental impurities in any of the following weight percentage ranges: up to 10.0; up to 5.0; up to 1.0; up to 0.5; up to 0.1; 0.1 to 10.0; 0.1 to 5.0; 0.1 to 1.0; and 0.1 to 0.5.

In various non-limiting embodiments, an alloy that may be processed by a method and embodied in a forged article according to the present disclosure may be non-magnetic. This characteristic may facilitate use of the alloy in applications in which non-magnetic properties are important including, for example, certain oil and gas drill string component applications. Certain non-limiting embodiments of an austenitic alloy that may be processed by the methods and embodied in the forged articles described herein may be characterized by a magnetic permeability value ($\mu_r$) within a particular range. In various non-limiting embodiments, the magnetic permeability value is less than 1.01, less than 1.005, and/or less than 1.001. In various embodiments, the alloy may be substantially free from ferrite.

In various non-limiting embodiments, an alloy that may be processed by a method and embodied in a forged article according to the present disclosure may be characterized by a pitting resistance equivalence number (PREN) within a particular range. As is understood, the PREN ascribes a relative value to an alloy's expected resistance to pitting corrosion in a chloride-containing environment. Generally, alloys having a higher PREN are expected to have better corrosion resistance than alloys having a lower PREN. One particular PREN calculation provides a $PREN_{16}$ value using the following formula, wherein the percentages are weight percentages based on total alloy weight:

$$PREN_{16}=\%\ Cr+3.3(\%\ Mo)+16(\%\ N)+1.65(\%\ W)$$

In various non-limiting embodiments, an alloy that may be processed by a method and embodied in a forged article according to the present disclosure may have a $PREN_{16}$ value in any of the following ranges: up to 60; up to 58; greater than 30; greater than 40; greater than 45; greater than 48; 30 to 60; 30 to 58; 30 to 50; 40 to 60; 40 to 58; 40 to 50; and 48 to 51. Without wishing to be bound to any particular theory, it is believed that a higher $PREN_{16}$ value may indicate a higher likelihood that an alloy will exhibit sufficient corrosion resistance in environments such as, for example, highly corrosive environments, high temperature environments, and low temperature environments. Aggressively corrosive environments may exist in, for example, chemical processing equipment and the down-hole environment to which a drill string is subjected in oil and gas drilling applications. Aggressively corrosive environments may subject an alloy to, for example, alkaline compounds, acidified chloride solutions, acidified sulfide solutions, peroxides, and/or $CO_2$, along with extreme temperatures.

In various non-limiting embodiments, an austenitic alloy that may be processed by a method and embodied in a forged article according to the present disclosure may be characterized by a coefficient of sensitivity to avoid precipitations value (CP) within a particular range. The concept of a CP value is described in, for example, U.S. Pat. No. 5,494,636, entitled "Austenitic Stainless Steel Having High Properties". In general, the CP value is a relative indication of the kinetics of precipitation of intermetallic phases in an alloy. A CP value may be calculated using the following formula, wherein the percentages are weight percentages based on total alloy weight:

$$CP=20(\%\ Cr)+0.3(\%\ Ni)+30(\%\ Mo)+5(\%\ W)+10(\%\ Mn)+50(\%\ C)-200(\%\ N)$$

Without wishing to be bound to any particular theory, it is believed that alloys having a CP value less than 710 will exhibit advantageous austenite stability which helps to minimize HAZ (heat affected zone) sensitization from intermetallic phases during welding. In various non-limiting embodiments, an austenitic alloy that may be processed by a method and embodied in a forged article according to the present disclosure may have a CP in any of the following ranges: up to 800; up to 750; less than 750; up to 710; less than 710; up to 680; and 660-750.

In various non-limiting embodiments, an austenitic alloy that may be processed by a method and embodied in a forged article according to the present disclosure may be characterized by a Critical Pitting Temperature (CPT) and/or a Critical Crevice Corrosion Temperature (CCCT) within particular ranges. In certain applications, CPT and CCCT values may more accurately indicate corrosion resistance of an alloy than the alloy's PREN value. CPT and CCCT may be measured according to ASTM G48-11, entitled "Standard Test Methods for Pitting and Crevice Corrosion Resistance of Stainless Steels and Related Alloys by Use of Ferric Chloride Solution". In various non-limiting embodiments, an austenitic alloy that may be processed by a method and embodied in a forged article according to the present disclosure has a CPT that is at least 45° C., or more preferably is at least 50° C., and has a CCCT that is at least 25° C., or more preferably is at least 30° C.

In various non-limiting embodiments, an austenitic alloy that may be processed by a method and embodied in a forged article according to the present disclosure may be characterized by a Chloride Stress Corrosion Cracking Resistance (SCC) value within a particular range. The concept of an SCC value is described in, for example, A. J. Sedricks, *Corrosion of Stainless Steels* (J. Wiley and Sons 1979). In various non-limiting embodiments, the SCC value of an alloy according to the present disclosure may be determined for particular applications according to one or more of the following: ASTM G30-97 (2009), entitled "Standard Practice for Making and Using U-Bend Stress-Corrosion Test Specimens"; ASTM G36-94 (2006), entitled "Standard Practice for Evaluating Stress-Corrosion-Cracking Resistance of Metals and Alloys in a Boiling Magnesium Chloride Solution"; ASTM G39-99 (2011), "Standard Practice for Preparation and Use of Bent-Beam Stress-Corrosion Test Specimens"; ASTM G49-85 (2011), "Standard Practice for Preparation and Use of Direct Tension Stress-Corrosion Test Specimens"; and ASTM G123-00 (2011), "Standard Test Method for Evaluating Stress-Corrosion Cracking of Stainless Alloys with Different Nickel Content in Boiling Acidified Sodium Chloride Solution." In various non-limiting embodiments, the SCC value of an austenitic alloy that may be processed by a method and embodied in a forged article according to the present disclosure is high enough to indicate that the alloy can suitably withstand boiling acidified sodium chloride solution for 1000 hours without experiencing unacceptable stress corrosion cracking, pursuant to evaluation under ASTM G123-00 (2011).

The examples that follow are intended to further describe certain non-limiting embodiments, without restricting the scope of the present invention. Persons having ordinary skill in the art will appreciate that variations of the following examples are possible within the scope of the invention, which is defined solely by the claims.

EXAMPLE 1

Figure 6:
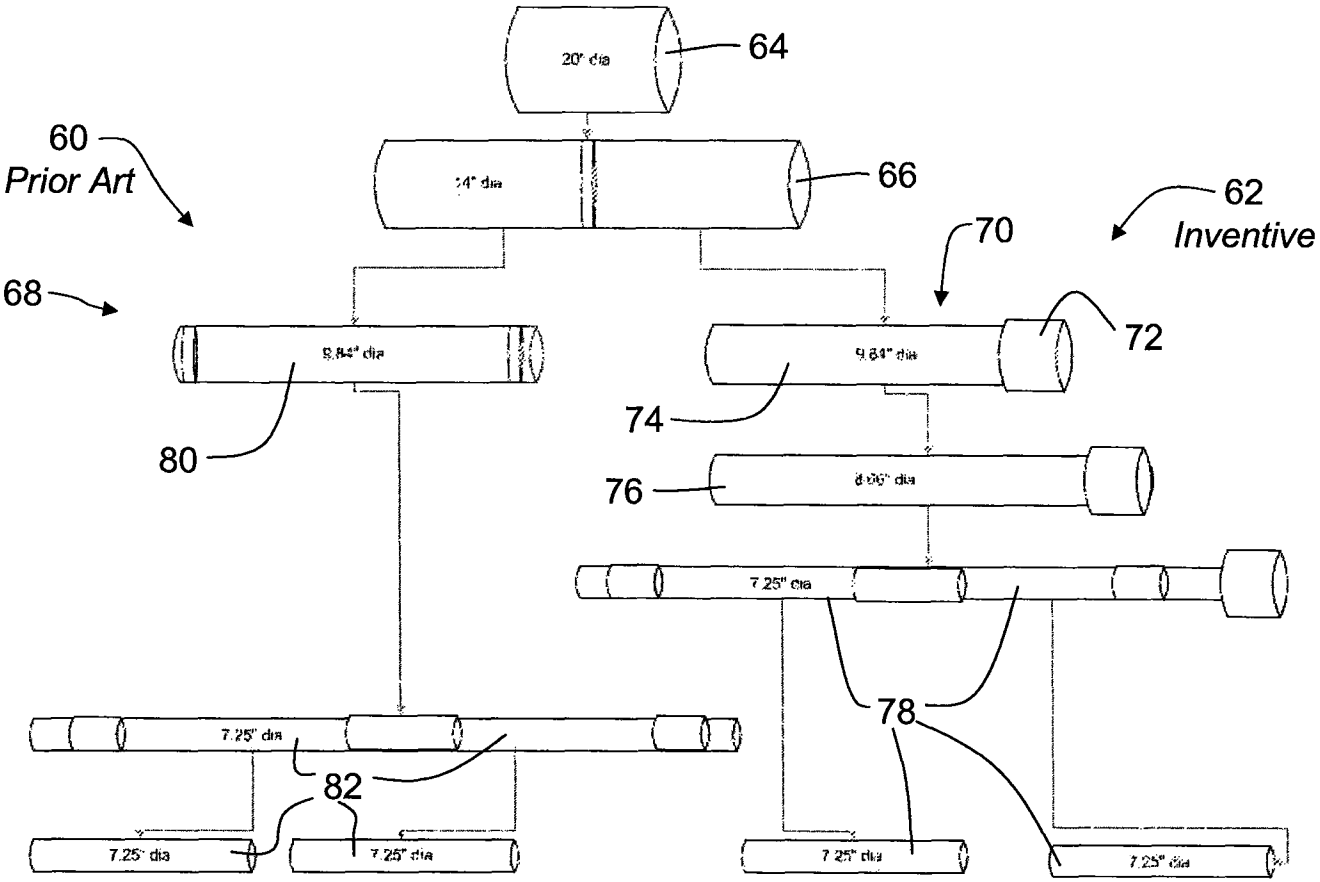
FIG. 6 is a process flow diagram illustrating steps used in processing Heat Number 49FJ-1,2 of Example 1 described herein, including an open die press forging step and a radial forging step as final processing steps, and also illustrating an alternate prior art process sequence including only a radial forging step as the final processing step.

FIG. 6 schematically illustrates aspects of a method 62 according to the present disclosure for processing a non-magnetic austenitic steel alloy (right side of FIG. 6) and a comparative method 60 (left side of FIG. 6). An electroslag remelted (ESR) ingot 64 having a diameter of 20 inches and having the chemistry of Heat Number 49FJ-1,2 shown in Table 2 below was prepared.

TABLE 2

| Element | Heat 01FM-1 | Heat 47FJ-1, 2 | Heat 49FJ-2, 4 |
|---|---|---|---|
| C | 0.014 | 0.010 | 0.010 |
| Mn | 4.53 | 4.50 | 4.55 |
| Cr | 21.50 | 22.26 | 21.32 |
| Mo | 5.01 | 6.01 | 5.41 |
| Co | 2.65 | 2.60 | 2.01 |
| Fe | 34.11 | 32.37 | 39.57 |
| Nb | <0.01 | 0.010 | 0.008 |
| Ni | 30.40 | 30.07 | 25.22 |
| W | 0.89 | 0.84 | 0.64 |
| N | 0.365 | 0.390 | 0.393 |
| P | 0.015 | 0.014 | 0.016 |
| S | <0.0003 | 0.0002 | 0.0003 |
| Si | 0.30 | 0.23 | 0.30 |
| Cu | 1.13 | 1.22 | 1.21 |
| V | 0.03 | 0.04 | 0.04 |
| B | 0.002 | 0.002 | 0.002 |
| $PREN_{16}$ | 44 | 50 | 47 |

The ESR ingot 64 was homogenized at 2225° F. for 48 hours, followed by ingot breakdown to about a 14-inch diameter workpiece 66 on a radial forge machine. The 14-inch diameter workpiece 66 was cut into a first workpiece 68 and a second workpiece 70 and processed as follows.

Samples of the 14-inch diameter second workpiece 70 were processed according to an embodiment of a method according to the present disclosure. Samples of the second workpiece 70 were reheated at 2225° F. for 6 to 12 hours and radial forged to a 9.84-inch diameter bar including step shaft 72 with a long end 74, and then water quenched. Step shaft 72 was produced during this radial forging operation to provide an end region on each forging 72,74 having a size that could be gripped by the workpiece manipulator for the open die press forge. Samples of the 9.84-inch diameter forgings 72,74 were annealed at 2150° F. for 1 to 2 hours and cooled to room temperature. Samples of the 9.84-inch diameter forgings 72,74 were reheated to 1025° F. for between 10 and 24 hours, followed by open die press forging to produce forgings 76. The forgings 76 were step shaft forgings, with the majority of each forgings 76 having a diameter of approximately 8.7 inches. Subsequent to open die press forging, the forgings were air cooled. Samples of the forgings 76 were reheated for between 3 to 9 hours at 1025° F. and radial forged to bars 78 having a diameter of approximately 7.25 inches. Test samples were taken from surface regions and central regions of the bars 78, in a middle section of the bars 78 between the bars' distal ends, and were evaluated for mechanical properties and hardness.

Samples of the 14-inch diameter first workpiece 68 were processed by a comparative method that is not encompassed by the present invention. Samples of the first workpiece 68 were reheated at 2225° F. for 6 to 12 hours, radial forged to 9.84-inch diameter workpieces 80, and water quenched. The 9.84-inch diameter forgings 80 were annealed at 2150° F. for 1 to 2 hours, and cooled to room temperature. The annealed and cooled 9.84-inch forgings 80 were reheated for 10 to 24 hours at 1025° F. or 1075° F. and radial forged to approximately 7.25-inch diameter forgings 82. Surface region and central region test samples for mechanical property evaluation and hardness evaluation were taken from the middle of each forging 82, between the distal ends of each forging 82.

Processing of other ingot heats were similar to those for Heat Number 49FJ-1,2, described above, except for the degree of warm working. The percent deformation and type of warm working used for other heats are shown in Table 3. Table 3 also compares the hardness profile across the 7.25-inch diameter forging 82 with that of the 7.25-inch diameter forging 78. As described above, the forgings 82 received only warm work radial forging at temperatures of 1025° F. or 1075° F. as a final processing step. In contrast, forgings 78 were processed using steps of warm work open press die forging at 1025° F., followed by warm work radial forging at 1025° F.

TABLE 3

| Heat No. | Process | Dia. (inch) | % Def | Warm Work Temp (° F.) | Hardness (MRC) Surface | | | Center | | | Surface |
|---|---|---|---|---|---|---|---|---|---|---|---|
| 47FJ-1 | no anneal; comparative | 7.25 | 35 | 1075 radial forge | 40.0 | 35.0 | 33.0 | 31.4 | 31.9 | 35.0 | 40.0 |
| 49FJ-2 | no anneal; comparative | 7.25 | 35 | 1075 radial forge | 41.6 | 38.0 | 35.0 | 33.0 | 34.1 | 36.0 | 40.0 |
| 47FJ-2 | anneal 2150° F.; WQ; comparative | 7.25 | 45 | 1025 radial forge | 43.9 | 41.6 | 35.0 | 33.4 | 36.2 | 40.3 | 42.9 |
| 49FJ-4 | anneal 2150° F.; WQ; comparative | 7.25 | 45 | 1025 radial forge | 38.5 | 35.2 | 32.4 | 32 | 32.4 | 38 | 39.2 |
| 49FJ-4 | anneal 2150° F.; WQ; inventive; press forge to radial forge | 7.25 | 45 | 1025 press forge; 1025 radial forge | 40.1 | 36.8 | 39.6 | 40.8 | 41.8 | 42.0 | 42.6 |
| 01FM-1 | anneal 2150° F.; WQ; comparative press forge; air cooled; reheated; press forge | 7.25 press forge; 5.25 press forge | 72 | 1025 press forge; 1025 press forge | 38.0 | 38.2 | 39.9 | 40.0 | | 40.0 | |

From Table 3, it is apparent that the difference in hardness from the surface to the center is significantly greater for the comparative samples than for the inventive samples. These results are consistent with the results shown in FIG. 3 from the modeling of the inventive press forge plus rotary forge process. The press forging process imparts the deformation mainly at the center region of the workpiece and the rotary forge operation imparts the deformation mainly at the surface. Since hardness is an indicator of the amount of deformation in these materials, it shows that the combination of press forging plus rotary forging provides a bar with a relatively even amount of deformation from surface to center. It is also seen from Table 3 that Heat 01 FM-1, which is a comparative example that was only warm worked by press forging, but warm work press forged to a smaller diameter of 5.25 inches. The results for Heat 01 FM-1 demonstrate that the amount of deformation provided by press forging on smaller diameter workpieces, may result in relatively even cross-sectional hardness profiles.

Table 1, hereinabove, shows the room temperature tensile properties for the comparative heats having the hardness values disclosed in Table 3. Table 4 provides a direct comparison of room temperature tensile properties for Heat No. 49-FJ-4 for a comparative sample that was warm worked by press forging only, and for an inventive sample that was warm worked by press forging followed by radial forging.

TABLE 4

| Heat No. | Final Anneal and Forge Steps | Direction and Test Region | Total Deformation (percent) | Final Diameter (inch) | Yield Strength (ksi) | Ultimate Tensile Strength (ksi) | Percent Elongation | Percent Reduction in Area |
|---|---|---|---|---|---|---|---|---|
| 49FJ-4 | annealed at 2150° F.; water quench; radial forge at 1025° F.; comparative | Long-NS | 45 | 7.25 | 156.9 | 170.1 | 30.6 | 67.3 |
| | | Transverse | 45 | 7.25 | 148.1 | 161.9 | 28.8 | 58.8 |
| | | Long-C | | | | | | |

TABLE 4-continued

| Heat No. | Final Anneal and Forge Steps | Direction and Test Region | Total Deformation (percent) | Final Diameter (inch) | Yield Strength (ksi) | Ultimate Tensile Strength (ksi) | Percent Elongation | Percent Reduction in Area |
|---|---|---|---|---|---|---|---|---|
| 49FJ-4 | annealed at 2150° F.; water quench; press forge at 1025° F.; radial forge at 1025° F.; inventive | Long-NS | 45 | 7.25 | 176.2 | 191.6 | 22.7 | 65.3 |
| | | Transverse | 45 | 7.25 | 187.8 | 195.3 | 20.4 | 62.5 |
| | | Long-C | | | | | | |

key:
Transverse = Transverse, specimen gauge length across central region
Long-NS = Longitudinal near surface region
Long-C = long center; central region The yield and ultimate tensile strengths at the surface of the comparative samples are greater than at the center. However, the ultimate tensile and yield strengths for the material processed according to the present disclosure (inventive sample) not only show that strength at the center of the billet and at the surface of the billet is substantially uniform, but also show that the inventive samples are considerably stronger than the comparative samples.

It will be understood that the present description illustrates those aspects of the invention relevant to a clear understanding of the invention. Certain aspects that would be apparent to those of ordinary skill in the art and that, therefore, would not facilitate a better understanding of the invention have not been presented in order to simplify the present description. Although only a limited number of embodiments of the present invention are necessarily described herein, one of ordinary skill in the art will, upon considering the foregoing description, recognize that many modifications and variations of the invention may be employed. All such variations and modifications of the invention are intended to be covered by the foregoing description and the following claims.

What is claimed is:

1. A method of processing a non-magnetic alloy workpiece, comprising:

heating the workpiece to a warm working temperature;

open the press forging the workpiece to impart a desired strain to a central region of the workpiece; and radial forging the workpiece to impart a desired strain to a surface region of the workpiece;

wherein after the open die press forging and the radial forging, the strain imparted to the central region and the strain imparted to the surface region are each in a range of from 0.3 inch/inch to 1.0 inch/inch;

wherein a difference in strain from the central region to the surface region is not more than 0.5 inch/inch.

2. The method of claim 1, wherein after the open die press forging and the radial forging, the strain imparted to the central region and the strain imparted to the surface region are each in a range of from 0.3 inch/inch to 0.8 inch/inch.

3. The method of claim 1, wherein after the open the press forging and the radial forging, the strain imparted to the surface region is substantially equivalent to the strain imparted to the central region.

4. The method of claim 1, wherein the open the press forging precedes the radial forging.

5. The method of claim 1, wherein the radial forging precedes the open the press forging.

6. The method of claim 1, wherein the warm working temperature is in a range spanning a temperature that is one-third of an incipient melting temperature of the non-magnetic ahoy up to a temperature that is two-thirds of an incipient melting temperature of the non-magnetic ahoy.

7. The method of claim 1, wherein the warm working temperature comprises any temperature up to the highest temperature at which recrystallization (dynamic or static) does not occur in the non-magnetic ahoy.

8. The method of claim 1, wherein the non-magnetic ahoy comprises one of a non-magnetic stainless steel alloy, a nickel ahoy, a cobalt alloy, and an iron alloy.

9. The method of claim 1, wherein the non-magnetic alloy comprises a non-magnetic austenitic stainless steel alloy.

10. The method of claim 9, wherein the warm working temperature is from 950° F. to 1150° F.

11. The method of claim 1, further comprising, prior to heating the workpiece to the warm working temperature, annealing the workpiece.

12. The method of claim 11, wherein the workpiece comprises a non-magnetic stainless steel alloy; and annealing the workpiece comprises heating the workpiece at 1850° F. to 2300° F. for 1 minute to 10 hours.

13. The method of claim 11, wherein the heating the workpiece to the warm working temperature further comprises allowing the workpiece to cool from an annealing temperature to the warm working temperature.

14. The method of claim 1, wherein the workpiece comprises a circular cross-section.

15. The method of claim 14, wherein the circular cross-section of the workpiece has a diameter greater than 5.25 inches.

16. The method of claim 14, wherein the circular cross-section of the workpiece has a diameter greater than or equal to 7.25 inches.

17. The method of claim 14, wherein the circular cross-section of the workpiece has a diameter in a range of 7.25 inches to 12.0 inches.

18. A method of processing a non-magnetic austenitic stainless steel alloy workpiece, the method comprising:

heating the workpiece to a warm working temperature in the range of 950° F. to 1150° F.;

open die press forging the workpiece to impart a final strain of between 0.3 inch/inch to 1.0 inch/inch in a central region of the workpiece; and radial forging the workpiece to impart a final strain of between 0.3 inch/inch to 1,0 inch/inch in a surface region of the workpiece;

wherein a difference in strain from the central region to the surface region is not more than 0.5 inch/inch.

19. The method of claim 18, wherein:

open the press forging the workpiece imparts a final strain of between 0.3 inch/inch to 0.8 inch/inch in a central region of the workpiece; and radial forging the workpiece imparts a final strain of between 0.3 inch/inch to 0.8 inch/inch in a surface region of the workpiece.

20. The method of claim 18, wherein the open die press forging precedes the radial forging.

21. The method of claim 18, wherein the radial forging precedes the open die press forging.

22. The method of claim 18, further comprising, prior to heating the workpiece to the warm working temperature, annealing the workpiece.

23. The method of claim 22, wherein annealing the workpiece comprises heating the workpiece at 1850° F. to 2300° F. for 1 minute to 10 hours.

24. The method of claim 22, wherein the heating the workpiece to the warm working temperature further comprises allowing the workpiece to cool from the annealing temperature to the warm working temperature.

25. The method of claim 18, wherein the workpiece comprises a circular cross-section.

26. The method of claim 25, wherein the circular cross-section of the workpiece has a diameter of greater than 5.25 inches.

27. The method of claim 25, wherein the circular cross-section of the workpiece has a diameter of greater than or equal to 7.25 inches.

28. The method of claim 25, wherein the circular cross-section of the workpiece has a diameter in a range of 7.25 inches to 12.0 inches.

* * * * *

UNITED STATES PATENT AND TRADEMARK OFFICE

CERTIFICATE OF CORRECTION

PATENT NO. : 9,192,981 B2
APPLICATION NO. : 13/792285
DATED : November 24, 2015
INVENTOR(S) : Forbes Jones et al.

It is certified that error appears in the above-identified patent and that said Letters Patent is hereby corrected as shown below:

Claims

Column 23, line 46, Claim 1, delete "open the press" and substitute therefor --open die press--

Column 23, line 60, Claim 3, delete "open the press" and substitute therefor --open die press--

Column 23, line 64, Claim 4, delete "open the press" and substitute therefor --open die press--

Column 23, line 67, Claim 5, delete "open the press" and substitute therefor --open die press--

Column 24, line 23, Claim 6, delete "ahoy" and substitute therefor --alloy--

Column 24, line 24, Claim 6, delete "ahoy" and substitute therefor --alloy--

Column 24, line 28, Claim 7, delete "ahoy" and substitute therefor --alloy--

Column 24, line 29, Claim 8, delete "ahoy" and substitute therefor --alloy--

Column 24, line 31, Claim 8, delete "ahoy" and substitute therefor --alloy--

Column 24, line 66, Claim 18, delete "1,0 inch/inch" and substitute therefor --1.0 inch/inch--

Column 25, line 4, Claim 19, delete "open the press" and substitute therefor --open die press--

Signed and Sealed this
Twenty-sixth Day of July, 2016

Michelle K. Lee

Michelle K. Lee
*Director of the United States Patent and Trademark Office*